US008857211B2

(12) United States Patent
Morozumi et al.

(10) Patent No.: US 8,857,211 B2
(45) Date of Patent: Oct. 14, 2014

(54) INJECTABLE TWO-STAGED ROTARY COMPRESSOR AND HEAT PUMP SYSTEM

(75) Inventors: Naoya Morozumi, Kanagawa (JP); Kenshi Ueda, Kanagawa (JP)

(73) Assignee: Fujitsu General Limited, Kanagawa (JP)

( * ) Notice: Subject to any disclaimer, the term of this patent is extended or adjusted under 35 U.S.C. 154(b) by 1293 days.

(21) Appl. No.: 12/073,733

(22) Filed: Mar. 10, 2008

(65) Prior Publication Data

US 2008/0236184 A1 Oct. 2, 2008

(30) Foreign Application Priority Data

Mar. 30, 2007 (JP) ..... 2007-094695

(51) Int. Cl.

| | |
|---|---|
| ***F25B 23/00*** | (2006.01) |
| ***F25B 31/00*** | (2006.01) |
| ***F25B 39/04*** | (2006.01) |
| ***F25B 41/00*** | (2006.01) |
| ***F04C 29/04*** | (2006.01) |
| ***F25B 1/04*** | (2006.01) |
| ***F25B 1/10*** | (2006.01) |
| ***F04C 18/344*** | (2006.01) |
| ***F04C 23/00*** | (2006.01) |

(52) U.S. Cl.

CPC ..... *F04C 29/042* (2013.01); *F25B 1/04* (2013.01); *F25B 2400/13* (2013.01); *F25B 1/10* (2013.01); *F04C 18/3442* (2013.01); *F25B 2700/21152* (2013.01); *F04C 23/001* (2013.01)

USPC ..... 62/467; 62/505; 62/508; 62/513

(58) Field of Classification Search

CPC ..... F25B 31/006; F25B 23/008

USPC ..... 62/324.6, 505, 510, 512, 513, 324, 600; 417/410.3, 410.4, 250, 902; 418/11, 418/15, 60, 63, 83–85

See application file for complete search history.

(56) References Cited

U.S. PATENT DOCUMENTS

| | | | | |
|---|---|---|---|---|
| 5,239,833 | A * | 8/1993 | Fineblum | 62/6 |
| 5,328,338 | A * | 7/1994 | Hirano et al. | 417/312 |
| 5,436,547 | A * | 7/1995 | Nagai et al. | 318/801 |
| 5,894,740 | A * | 4/1999 | Renz | 62/468 |

(Continued)

FOREIGN PATENT DOCUMENTS

| | | | | |
|---|---|---|---|---|
| DE | 20003123 | * | 4/2000 | F04B 39/00 |
| JP | 57-033758 | | 2/1982 | |

(Continued)

OTHER PUBLICATIONS

Chinese Office Action issued in Chinese Patent Application No. 200810007740.2, mailed Mar. 11, 2011.

(Continued)

*Primary Examiner* — Alexandra Elve
*Assistant Examiner* — Henry Crenshaw
(74) *Attorney, Agent, or Firm* — McDermott Will & Emery LLP

(57) ABSTRACT

In an injectible two-staged rotary compressor, a second suction pipe includes a heat-exchange promoting unit that promotes heat exchange between intermediary-pressure injected refrigerant and internal space or an external surface of a sealed container. The heat being exchanged by the intermediary-pressure injected refrigerant absorbing heat.

19 Claims, 18 Drawing Sheets

(56) References Cited

U.S. PATENT DOCUMENTS

| | | | | |
|---|---|---|---|---|
| 6,041,608 | A * | 3/2000 | Fujiwara | 62/229 |
| 6,178,758 | B1 * | 1/2001 | Schwarzpaul | 62/129 |
| 7,591,147 | B2 * | 9/2009 | Masoudipour et al. | 62/505 |
| 7,647,790 | B2 * | 1/2010 | Ignatiev et al. | 62/512 |
| 2003/0126885 | A1 * | 7/2003 | Ebara et al. | 62/505 |
| 2004/0107948 | A1 * | 6/2004 | Meshenky et al. | 123/559.1 |
| 2004/0151603 | A1 * | 8/2004 | Tadano et al. | 417/312 |
| 2005/0089413 | A1 * | 4/2005 | Sato et al. | 417/410.3 |
| 2005/0126194 | A1 * | 6/2005 | Ebara et al. | 62/228.3 |
| 2005/0235672 | A1 * | 10/2005 | Hsu et al. | 62/259.2 |
| 2005/0281691 | A1 * | 12/2005 | Lee | 417/417 |
| 2006/0005558 | A1 * | 1/2006 | Otake et al. | 62/260 |
| 2006/0201175 | A1 * | 9/2006 | Shapiro et al. | 62/246 |
| 2006/0260354 | A1 * | 11/2006 | Nakatani et al. | 62/513 |
| 2006/0277932 | A1 * | 12/2006 | Otake et al. | 62/196.1 |
| 2006/0280626 | A1 * | 12/2006 | Nishimura et al. | 417/410.4 |
| 2008/0168796 | A1 * | 7/2008 | Masoudipour et al. | 62/505 |
| 2008/0236184 | A1 * | 10/2008 | Morozumi et al. | 62/324.6 |
| 2009/0044548 | A1 * | 2/2009 | Masoudipour et al. | 62/115 |
| 2009/0282849 | A1 * | 11/2009 | Fujimoto et al. | 62/228.5 |

FOREIGN PATENT DOCUMENTS

| | | |
|---|---|---|
| JP | 61285352 | 12/1986 |
| JP | 63-117192 | 5/1988 |
| JP | 64-090961 | 4/1989 |
| JP | 06-300366 | 10/1994 |
| JP | 11-132575 | 5/1999 |
| JP | 2000-054975 | 2/2000 |
| JP | 2000-73974 | 3/2000 |
| JP | 2000-073974 | 3/2000 |
| JP | 2000-097177 A | 4/2000 |
| JP | 2004-85019 | 3/2004 |

OTHER PUBLICATIONS

Japanese Notice of Rejection, w/ English translation thereof, issued in Japanese Patent Application No. JP 2007-094695 dated Aug. 18, 2009.

Decision of a Patent Grant with English Translation issued in Japanese Patent Application No. 2012-004471 dated Jun. 18, 2013.

Korean Office Action issued in Korean Patent Application No. KR 10-2008-0021110 dated Nov. 5, 2013.

* cited by examiner

INJECTABLE TWO-STAGED ROTARY COMPRESSOR AND HEAT PUMP SYSTEM

BACKGROUND OF THE INVENTION

1. Field of the Invention

The present invention relates to an injectible two-staged rotary compressor and a heat pump system.

2. Description of the Related Art

The gas injection cycle is advantageous in that it increases the amount of refrigerant circulated through a heat radiator, and improves a heat-radiating capacity (heater capacity or water heater capacity). These advantages are achieved by having a structure in which a compressor sucks in additional refrigerant also during a compression process. Especially in cold regions, the amount of the circulated refrigerant decreases, because a base gas sucked into the compressor is diluted because of cold; therefore, it is effective to increase the amount of circuited refrigerant by an injection. Even if the injection is performed during the compression process, the amount of the refrigerant circulating through an evaporator stays the same, because the amount of the circulated refrigerant is determined by a basic displacement capacity and a rotation frequency of the compressor. However, it is possible to improve evaporating capacity (cooler capacity) too, by liquefying the refrigerant in a gas-liquid separator, or providing additional overcooling in an internal heat exchanger at an entry point to the evaporator.

In such a gas injection cycle, it is known that the compressor efficiency can be improved by mixing a small amount of liquefied refrigerant to the refrigerant to be injected to the compressor, partly because the liquefied refrigerant has a cooling effect on the compressor (for an example, see Japanese Patent Application Laid-Open No. 2004-85019). In addition, to maintain the reliability of a compressor, the compressor must be limited in operating pressure ratio and rotation frequency. This is because the higher the operating pressure ratio and the rotation frequency the compressor become, the more the compressor is heated up. Because of the cooling effect described above, these limitations can also be advantageously alleviated.

However, in the conventional gas injection cycle, the reliability decreases if too much liquefied refrigerant is mixed into the injected refrigerant. Because, too much of liquefied refrigerant reduces the viscosity of the lubricants, causing defective lubrication or defective sealing, and increase in bearing loads with still more liquefied refrigerant being mixed (for an example, see Japanese Patent Application Laid-Open No. 11-132575).

In other words, an appropriate amount of the liquefied refrigerant must be mixed to the refrigerant before the refrigerant is sucked into the compressor. The conventional documents teach methods of mixing the liquefied refrigerant and the injected refrigerant in an appropriate ratio, i.e., controlling a variable expansion valve or a flow-rate controlling valve in the gas injection cycle.

There has been a need to further improve the efficiency of the compressor.

SUMMARY OF THE INVENTION

It is an object of the present invention to at least partially solve the problems in the conventional technology.

According to an aspect of the present invention, there is provided an injectible two-staged rotary compressor for use in a heat pump system that employs an injection refrigerating cycle. The rotary compressor includes a sealed container; a lower stage compressing unit; an upper stage compressing unit; a motor that drives the lower stage compressing unit and the upper stage compressing unit; a first suction pipe that is connected to a suction side of the lower stage compressing unit to lead a low-pressure refrigerant of the injection refrigerating cycle to the lower stage compressing unit; an interconnecting path that connects a discharging side of the lower stage compressing unit to a suction side of the upper stage compressing unit; a discharging pipe that is connected to the sealed container, to discharge a high-pressure refrigerant, discharged into the sealed container from the upper stage compressing unit, into the injection refrigerating cycle; and a second suction pipe that leads an intermediary-pressure injected refrigerant that is a wet refrigerant from the injection refrigerating cycle to the interconnecting path. The second suction pipe is provided with a heat-exchange promoting unit that promotes exchange of heat between the intermediary-pressure injected refrigerant and an internal space or an external surface of the sealed container, the heat being absorbed by the intermediary-pressure injected refrigerant.

According to another aspect of the present invention, there is provided an injectible two-staged rotary compressor for use in a heat pump system that employs an injection refrigerating cycle. The rotary compressor includes a sealed container; a lower stage compressing unit; an upper stage compressing unit; a motor that drives the lower stage compressing unit and the upper stage compressing unit; a first suction pipe that is connected to a suction side of the lower stage compressing unit to lead a low-pressure refrigerant of the injection refrigerating cycle to the lower stage compressing unit; an interconnecting path that connects a discharging side of the lower stage compressing unit to a suction side of the upper stage compressing unit; a discharging pipe that is connected to the sealed container, to discharge a high-pressure refrigerant, discharged into the sealed container from the upper stage compressing unit, into the injection refrigerating cycle; and a second suction pipe that leads an intermediary-pressure injected refrigerant that is a wet refrigerant from the injection refrigerating cycle to the interconnecting path. The interconnecting path is provided with a heat-exchange promoting unit that promotes exchange of heat between a refrigerant discharged from the lower stage compressing unit and an internal space or an external surface of the sealed container, the heat being absorbed by the refrigerant discharged from the lower stage compressing unit absorbing heat.

According to still another aspect of the present invention, there is provided an injectible two-staged rotary compressor for use in a heat pump system that employs an injection refrigerating cycle. The rotary compressor includes a sealed container; a lower stage compressing unit; an upper stage compressing unit; a motor that drives the lower stage compressing unit and the upper stage compressing unit; a first suction pipe that is connected to a suction side of the lower stage compressing unit to lead a low-pressure refrigerant of the injection refrigerating cycle to the lower stage compressing unit; an interconnecting path that connects a discharging side of the lower stage compressing unit to a suction side of the upper stage compressing unit; a discharging pipe that is connected to the sealed container, to discharge a high-pressure refrigerant, discharged into the sealed container from the upper stage compressing unit, into the injection refrigerating cycle; and a second suction pipe that leads an intermediary-pressure injected refrigerant that is a wet refrigerant from the injection refrigerating cycle to the interconnecting path. The interconnecting path is provided with a heat-exchange promoting unit that promotes exchange of heat between a mixed refrigerant that is a mix of the refrigerant discharged from the lower stage compressing unit and the intermediary-pressure injected refrigerant, and an internal space or an external surface of the sealed container, the heat being absorbed by the mixed refrigerant of the refrigerant discharged from the lower stage compressing unit and the intermediary-pressure injected refrigerant.

According to still another aspect of the present invention, there is provided a heat pump system including the above compressor; a heat radiator; a first expanding unit; a heat absorber; a main circulation pipe that connects the compressor, the heat radiator, the first expanding unit, and the heat absorber in sequence to circulate a refrigerant; a branching pipe that is arranged on the main circulation pipe at a position between the heat radiator and the first expanding unit; a second expanding unit; an injection pipe that connects the branching pipe and the compressor with the second expanding unit therebetween to circulate the injected refrigerant; and a heat exchanger that is operative to perform heat between at least a part of a section between the branching pipe and the first expanding unit in the main circulation pipe, and at least a part of a section between the second expanding unit and the compressor the injection pipe.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an injectible two-staged rotary compressor and a heat pump system according to the present invention will be now explained in detail with reference to the attached drawings. It should be understood that the embodiments explained below are not intended to limit the scope of the present invention, and these embodiments may be modified in any way as appropriate without deviating from the purpose of the present invention. Elements disclosed in the embodiments shall also include those that can be easily imagined by those in the art, or that are substantially the same as the elements known by those in the art.

Figure 1:
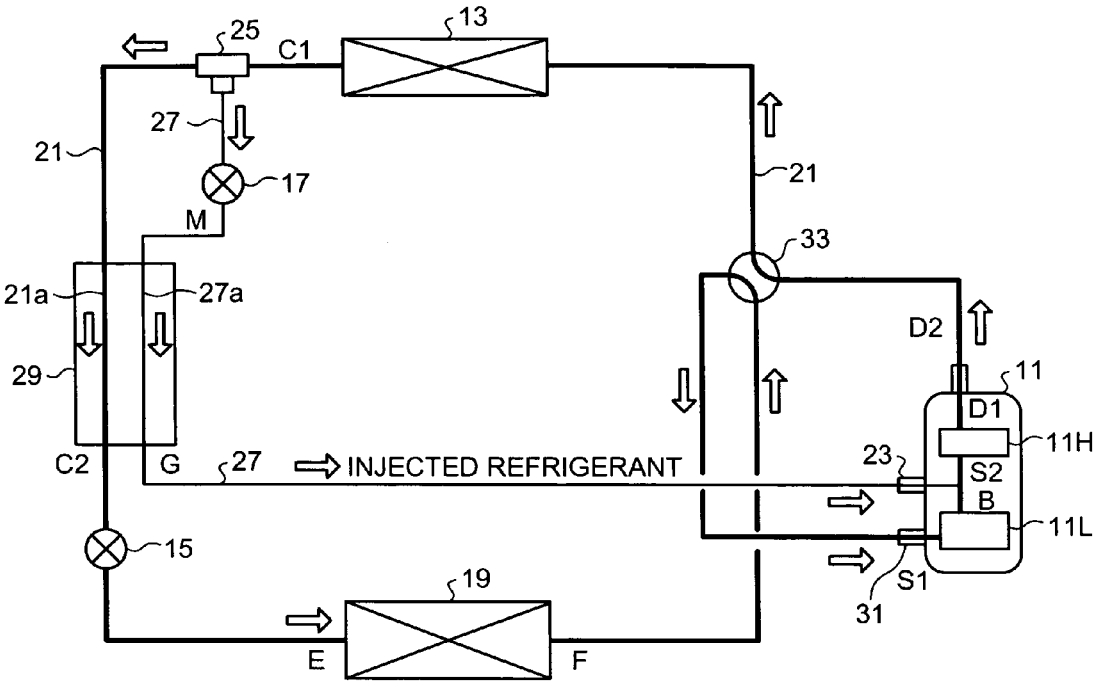
FIG. 1 is a schematic for explaining a basic structure of an air conditioner and a refrigerating cycle according to a first embodiment of the present invention.

FIG. 1 is a schematic for explaining a basic structure of and air conditioner and a refrigerating cycle according to a first embodiment of the present invention. In the air conditioner according to the first embodiment, an injection cycle with an internal heat exchanger is adopted as an approach to increase an enthalpy of the injected refrigerant, as shown in FIG. 1. This heat pump system includes an injectible two-staged rotary compressor according to the embodiments of the present invention.

As shown in FIG. 1, the air conditioner according to the first embodiment includes an injectible two-staged rotary compressor (hereinafter, "compressor") 11, a condenser (heat radiator) 13, a first expanding mechanism unit 15, a second expanding mechanism unit 17, an evaporator (heat absorber) 19, and a main circulation pipe 21.

The compressor 11 is an injectible two-staged rotary compressor, and further includes a lower stage compressing unit 11L and an upper stage compressing unit 11H. The lower stage compressing unit 11L and the upper stage compressing unit 11H are connected by an interconnecting pipe, and a second suction pipe 23 is connected to the interconnecting pipe. The second suction pipe 23 is used to suck an intermediate-pressure injected refrigerant. The intermediate pressure is a pressure between the pressure of the refrigerant in the condenser and the pressure in the evaporator. The compressor 11 is a so-called "inverter compressor", i.e., the rotation frequency of the compressor 11 can be controlled by changing the frequency of power supply.

The first expanding mechanism unit 15 is a variable throttling mechanism that is operative to optimally control the internal pressures of the condenser 13 and the evaporator 19 depending on an outdoor temperature and a preset indoor temperature. The second expanding mechanism unit 17 is a variable throttling mechanism that is operative to optimally control the amount of injected refrigerant. The main circulation pipe 21 connects each of the elements in the order as described above, and enables circulation of the refrigerant therethrough.

The air conditioner further includes a branching pipe 25, a first injection pipe 27, and an internal heat exchanger 29. The branching pipe 25 is arranged on the main circulation pipe 21 at a position between the condenser 13 and the first expanding mechanism unit 15, and branches the refrigerant off from a basic cycle to an injection cycle. The injection pipe 27 extends from the branching pipe 25 to the second suction pipe 23 and passes through the second expanding mechanism unit 17. The internal heat exchanger 29 facilitates heat exchange between a main circulation pipe 21*a* and an injection pipe 27*a*. The main circulation pipe 21*a* is a portion of the main circulation pipe 21 between the branching pipe 25 and the first expanding mechanism unit 15, while the injection pipe 27*a* is a portion of the injection pipe 27 between the second expanding mechanism unit 17 and the second suction pipe 23.

A four-way valve 33 is connected to the compressor 11. The four-way valve 33 makes it possible to reverse the direction of the flow of the refrigerant in the basic cycle so that the air conditioner can be used both as a heater and a cooler. When the four-way valve 33 is reversed, the functions of the condenser 13 and the evaporator 19 are also reversed. In other words, when the four-way valve 33 is reversed, the evaporator 19 will function as a condenser 19, and the condenser 13 will function as an evaporator 13. In the configuration shown in FIG. 1, the four-way valve 33 is provided so that the condenser 13, which is located between the four-way valve 33 and the branching pipe 25 functions as a condenser. Therefore, if the heat exchanger in this arrangement is installed in an indoor unit, the air conditioner operates as a heater.

In this example according to the first embodiment, injection of the refrigerant can be performed only with an air conditioner operating as a heater, when the heat exchanger, connected between the four-way valve 33 and the branching pipe 25, is installed to the indoor unit. However, to enable injection of the refrigerant also during cooler operation, a switching pipe may be provided, so that the condenser 13 and the evaporator 19 are connected in a reversed direction with respect to the first expanding mechanism unit 15, the internal heat exchanger, and the branching pipe 25. In the first embodiment, the refrigerant in the basic cycle (hereinafter, "basic-cycle refrigerant") flows in a direction in parallel to that of the refrigerant in the injection cycle (hereinafter, "injected refrigerant"). However, these refrigerants may be also directed in opposing directions.

With reference to FIG. 1, it will be now explained how refrigerant flows through the air conditioner when the air conditioner is operating as a heater. A high-temperature and high-pressure gas refrigerant discharged from the compressor 11 exchanges heat with the air in the condenser (heat radiator) 13, releasing heat. Because of the heat exchange, the gas refrigerant is liquefied. A part of the liquefied refrigerant is branched off at the branching pipe 25, and directed to the injection pipe 27 as the injected refrigerant. The remaining refrigerant is directed to the main circulation pipe 21 as the main-cycle refrigerant.

The injected refrigerant that is flowing the injection pipe 27 is decompressed to an intermediate pressure in the second expanding mechanism unit 17 to become two-phased at an intermediate temperature. While flowing through the injection pipe 27*a* in the internal heat exchanger 29, the injected refrigerant exchanges heat with the refrigerant flowing through the main circulation pipe 21*a* in the internal heat exchanger 29, absorbing heat, to become drier. Subsequently, the injected refrigerant exchanges heat with the gas discharged from the upper stage compressing unit 11H to the internal space of a sealed container in the compressor 11, absorbing heat, to become further drier. The injected refrigerant is mixed with the gas discharged from the lower stage compressing unit 11L, and the refrigerant, gasified as a whole, is sucked into the upper stage compressing unit 11H.

While flowing through the main circulation pipe 21*a* in the internal heat exchanger 29, the refrigerant flowing through the main circulation pipe 21 releases heat by exchanging heat with the injected refrigerant at an intermediate temperature that flows through the injection pipe 27*a* in the internal heat exchanger 29, to become more overcooled. Subsequently, the refrigerant in the main circulation pipe 21 is decompressed in the first expanding mechanism unit 15 to become two-phased at a low-temperature and a low-pressure. The refrigerant then exchanges heat with the air in the evaporator (heat absorber) 19, absorbing heat, to become overheated.

The overheated refrigerant flows through a first injection pipe 31 in the compressor 11 through the four-way valve 33, and sucked into the lower stage compressing unit 11L. The refrigerant sucked into the lower stage compressing unit 11L is decompressed therein, discharged from the lower stage compressing unit 11L, mixed with the injected refrigerant, and is sucked into the upper stage compressing unit 11H.

The refrigerant sucked into the upper stage compressing unit 11H is compressed therein to a high pressure, which is the pressure for the final discharging, and discharged into an internal space of the sealed container in the compressor 11. The refrigerant, discharged into the internal space of the sealed container of the compressor 11, exchanges heat with the injected refrigerant in the sealed container, and is discharged out of the sealed container of the compressor 11 through a discharging pipe.

Figure 2:
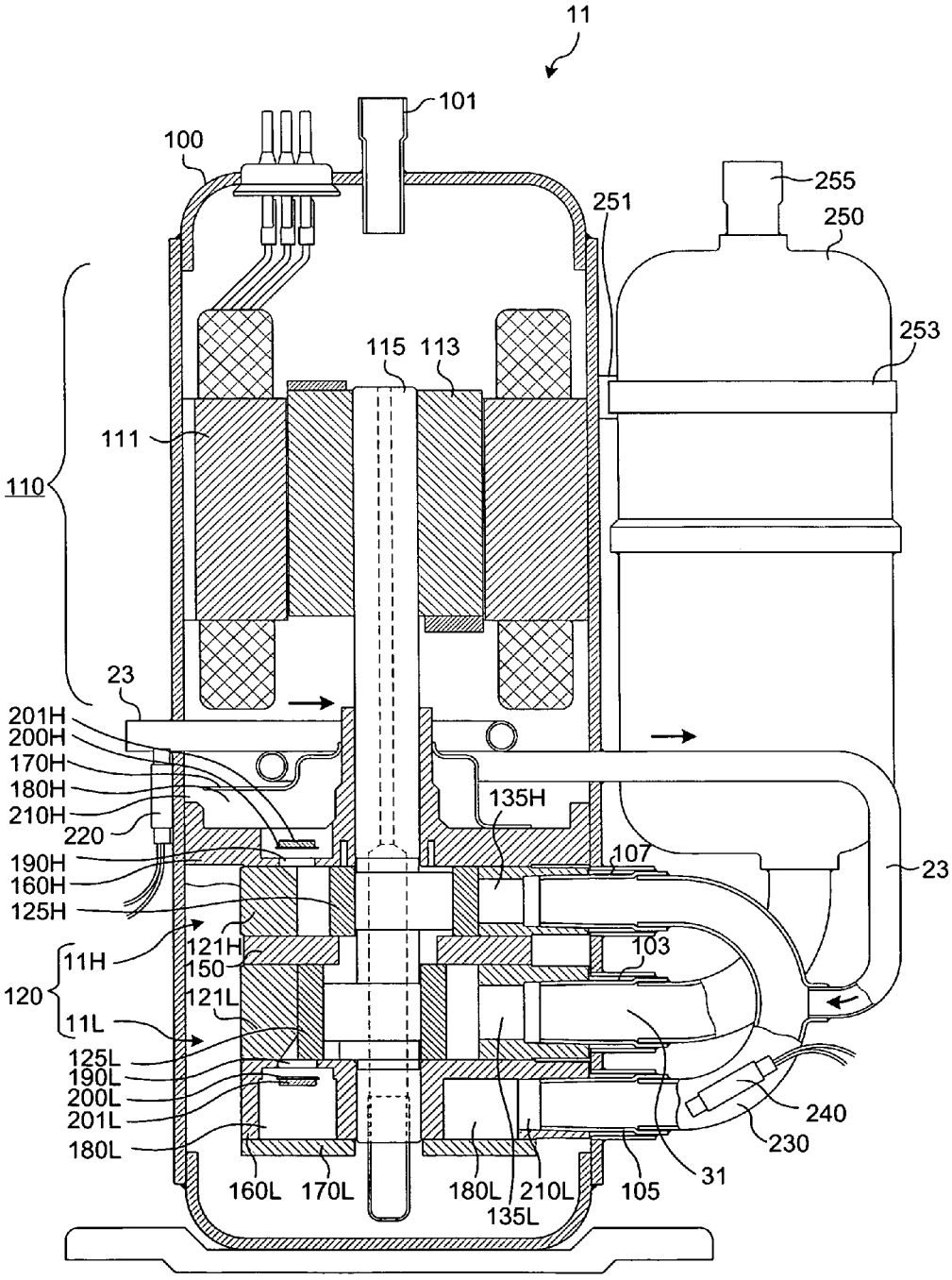
FIG. 2 is a cross-sectional view of a compressor shown in FIG. 1.

The compressor 11 in the air conditioner according to the first embodiment will be now explained. FIG. 2 is a cross-sectional view for explaining the compressor 11 in the air conditioner according to the first embodiment. The compressor 11 includes a cylinder-shaped, sealed container 100 arranged in a vertical direction, a compressing unit 120, and a motor 110 for driving the compressing unit 120, both of which are arranged within the sealed container 100.

A stator 111 of the motor 110 is fixed onto the internal surface of the sealed container 100 by shrink-fitting. A rotor 113 of the motor 110 is fixed to a driving shaft 115 by shrink-fitting that is arranged at the center of the stator 111, connecting the motor 110 and the compressing unit 120 mechanically.

Figure 3:
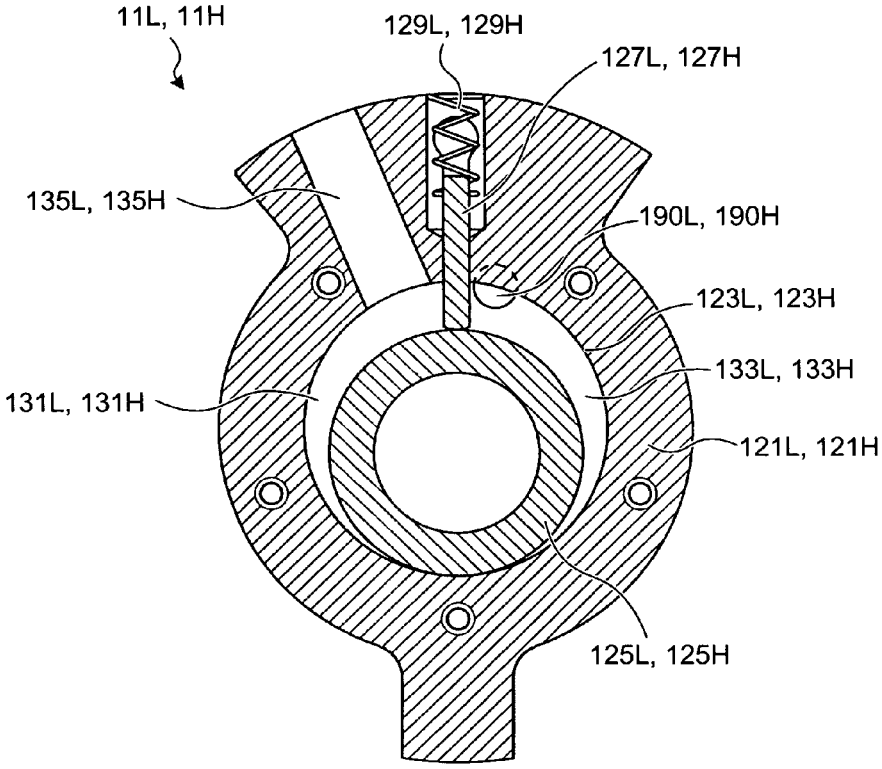
FIG. 3 is a cross-sectional view for explaining a main structure of a lower stage compressing unit and an upper stage compressing unit shown in FIG. 2.

The compressing unit 120 includes the lower stage compressing unit 11L, and the upper stage compressing unit 11H arranged above the lower stage compressing unit 11L, both of which are connected in line. FIG. 3 is a schematic for explaining a main structure of the lower stage compressing unit 11L and the upper stage compressing unit 11H. The lower stage compressing unit 11L mainly includes a lower stage cylinder 121L. The upper stage compressing unit 11H mainly includes an upper stage cylinder 121H.

The lower stage cylinder 121L and the upper stage cylinder 121H have cylinder bores 123L, 123H, respectively, on the same axis as the motor 110. Cylinder-shaped pistons 125L, 125H, smaller in diameter than the cylinder bores 123L, 123H, are arranged in the cylinder bores 123L, 123H. By way of this arrangement, an operating space is created between the cylinders 121L, 121H and the pistons 125L, 125H, respectively, allowing pressure-feeding of the refrigerant.

Each of the two cylinders 121L, 121H has a groove, extending from the cylinder bores 123L, 123H toward outside across the walls thereof. A plate-like vanes 127L, 127H are inserted in each of these grooves. Springs 129L, 129H are inserted, respectively, between the vanes 127L, 127H and the internal surface of the sealed container 100. By way of spring force of these springs 129L, 129H, one ends of the vanes 127L, 127H are pushed against the outer surface of the pistons 125L, 125H, respectively. In this manner, the operating space is compartmentalized into suction rooms 131L, 131H and compression rooms 133L, 133H.

To suck the refrigerant into each of the suction rooms 131L, 131H, the lower stage cylinder 121L and the upper stage cylinder 121H have suction holes 135L, 135H, respectively, connected to the suction rooms 131L, 131H.

An intermediary partitioning plate 150 is arranged between the lower stage cylinder 121L and the upper stage cylinder 121H, closing an opening of the operating space on top of the lower stage cylinder 121L, and an opening of the operating space at the bottom of the upper stage cylinder 121H. A lower stage end plate 160L is arranged at the bottom of the lower stage cylinder 121L, closing an opening of the operating space at the bottom of the lower stage cylinder 121L. An upper stage end plate 160H is arranged on top of the upper stage cylinder 121H, closing an opening of the operating space on top of the upper stage cylinder 121H.

A lower stage muffler cover 170L is arranged at the bottom of the lower stage end plate 160L, forming a lower stage discharging muffler room 180L with the lower stage end plate 160L. The discharge from the lower stage compressing unit 11L is released into the lower stage discharging muffler room 180L. In other words, the lower stage end plate 160L has a lower stage discharging hole 190L that connects the operating space in the lower stage cylinder 121L to the lower stage discharging muffler room 180L, and the lower stage discharging hole 190L includes a lower stage discharging valve 200L to prevent back-flow.

Figure 4:
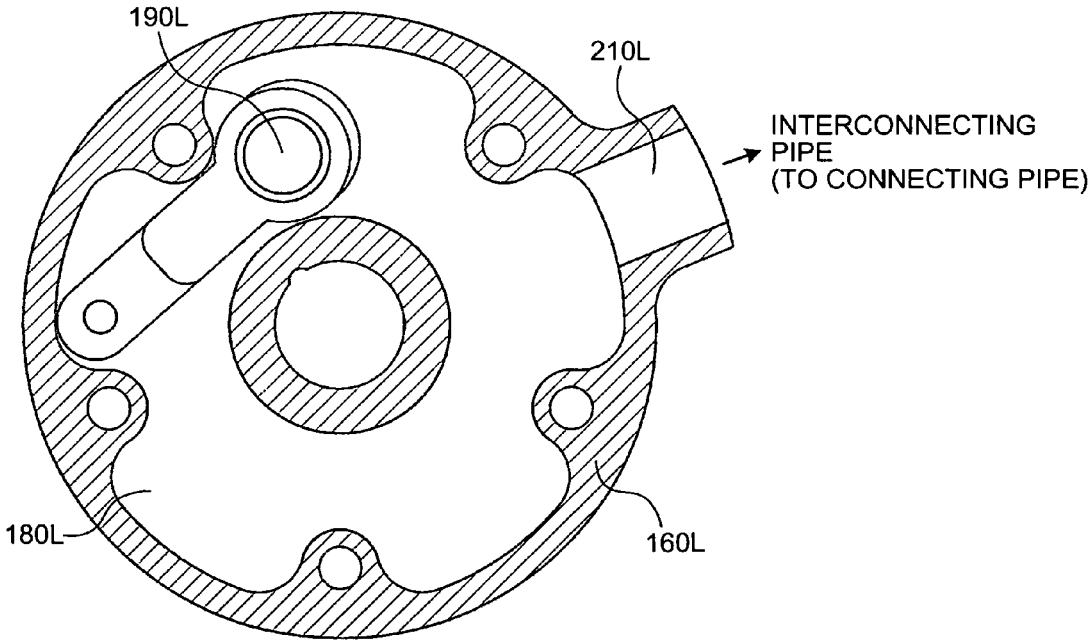
FIG. 4 is a cross-sectional view of a lower stage end plate shown in FIG. 2.
Figure 5:
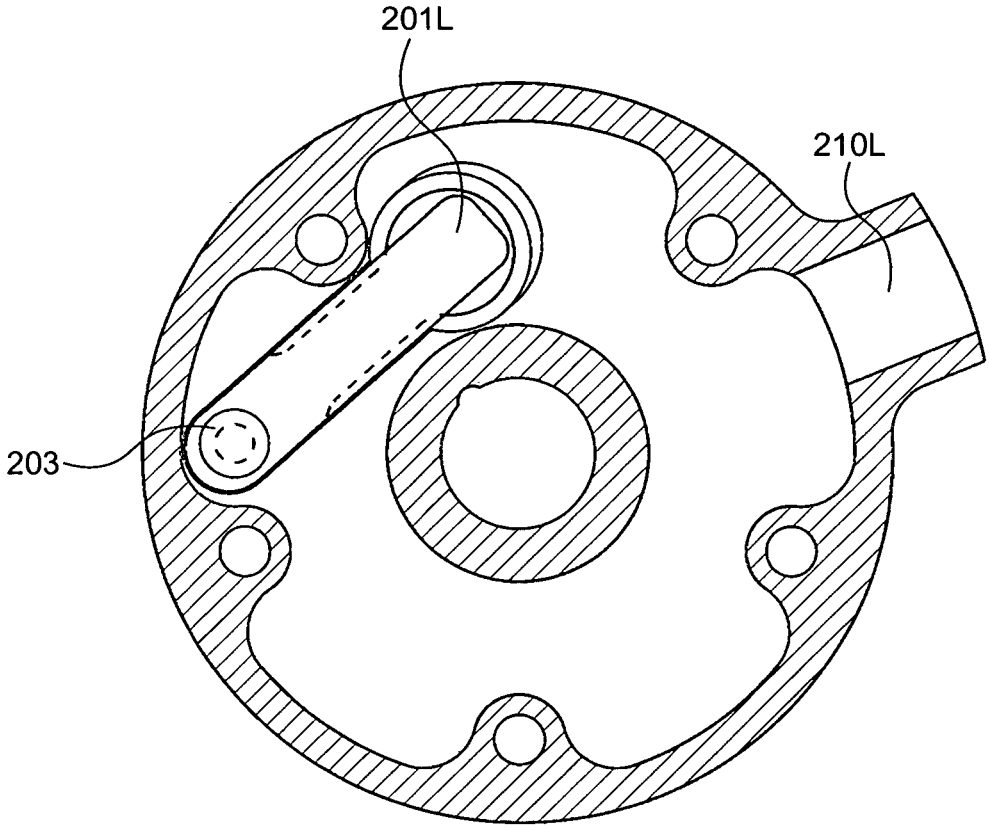
FIG. 5 is a cross-sectional view of a lower stage discharging valve shown in FIG. 2.
Figure 6:
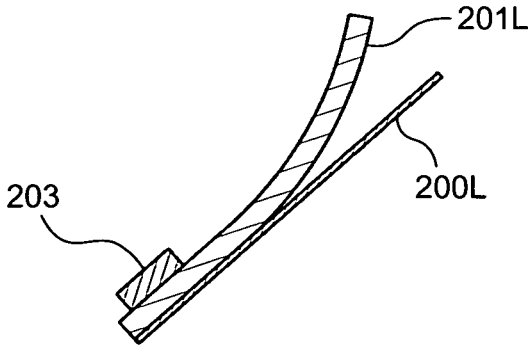
FIG. 6 is another cross-sectional view of the lower stage discharging valve shown in FIG. 5.

FIG. 4 is a schematic for explaining the lower stage end plate 160L in the compressor 11 according to the first embodiment, which is a transverse sectional view thereof. FIGS. 5 and 6 are cross-sectional views for explaining the lower stage discharging valve 200L. As shown in FIGS. 4 *and* 5, the lower stage discharging muffler room 180L according to the first embodiment is a space that the right side and the left side thereof are connected, and forms a part of the intermediary path connecting the discharging side of the lower stage compressing unit 11L with the suction side of the upper stage compressing unit 11H.

As shown in FIGS. 5 and 6, a discharging valve holder 201L is fixed on the lower stage discharging valve 200L by way of a rivet 203 to limit the movement of the lower stage discharging valve 200L. On the external periphery wall part of the lower stage end plate 160L, a lower stage muffler discharging hole 210L is provided for discharging the refrigerant from the lower stage discharging muffler room 180L.

A high-stage side muffler cover 170H is arranged on top of the high-stage side end plate 160H, forming a upper stage discharging muffler room 180H with the high-stage side end plate 160H. The high-stage side end plate 160H has a high-stage side discharging hole 190H that connects the operating space in the high-stage side cylinder 121H to the high-stage side muffler cover 170H, and the high-stage side discharging hole 190H includes a high-stage side discharging valve 200H to prevent back-flow. A discharging valve holder 201H is fixed onto the high-stage side discharging valve 200H by way of a rivet to limit the movement of the high-stage side discharging valve 200H.

Between the high-stage side end plate 160H and the high-stage side muffler cover 170H, a high-stage side muffler discharging hole 210H is opened toward the internal wall part of the sealed container 100, connecting the upper stage discharging muffler room 180H and the space inside the sealed container 100. On the external surface of the sealed container 100, at a position located at opposite side of the high-stage side muffler discharging hole 210H, a temperature sensor 220 is provided to measure the temperature of the refrigerant discharged from high-stage side muffler discharging hole 210H.

The lower stage cylinder 121L, the lower stage end plate 160L, the lower stage muffler cover 170L, the upper stage cylinder 121H, the upper stage end plate 160H, the upper stage muffler cover 170H, and the intermediary partitioning plate 150 are fixed together with bolts. In the compressing unit that is fixed together as one piece by the bolts, the external periphery of the upper stage end plate 160H is fixed onto the sealed container by way of spot welding, holding the compressing unit against the sealed container.

A first suction pipe 31 is connected to the suction side of the lower stage compressing unit 11L, that is, to the suction hole 135L via a connecting pipe 103, to suck in the low-pressure refrigerant from the basic cycle of the injection cycle. The second suction pipes 23, for sucking in the injected refrigerant, is extended between the compressing unit 120 and the motor 110, and the end thereof is connected to an interconnecting pipe 230.

The discharging side of the lower stage discharging muffler room 180L, that is, the lower stage muffler discharging hole 210L is connected to the interconnecting pipe 230, shaped in an approximate U-shape arranged outside of the sealed container 100, via a connecting pipe 105. The other end of the interconnecting pipe 230 is connected to the suction hole 135H of the upper stage compressing unit 11H via a connecting pipe 107. In other words, the interconnecting path connecting the discharging side of the lower stage compressing unit 11L with the upper stage compressing unit 11H is made from the lower stage discharging muffler room 180L, the lower stage muffler discharging hole 210L, the interconnecting pipe 230, and the suction hole 35H of the upper stage compressing unit 11H. The second suction pipe 23 is connected to the U-shaped, approximate center of the interconnecting pipe 230. On the external surface of an upstream side of a position where the second suction pipe 23 is connected in the interconnecting pipe 230, in other words, on the external surface of the interconnecting pipe 230, at a position closer to the lower stage compressing unit 11L, a temperature sensor 240 is provided to measure the temperature of the refrigerant discharged from the lower stage discharging muffler room 180L.

The refrigerant in the upper stage compressing unit 11H is released to the upper stage discharging muffler room 180H, and the refrigerant in the upper stage discharging muffler room 180H is released into the internal space of the sealed container 100. A discharging pipe 101 is connected on top of the sealed container 100 to discharge the refrigerant in the sealed container 100 out of the refrigerating cycle side.

Within the sealed container 100 of the compressor 11, lubricating oil is sealed in approximately up to a level of the high-stage side cylinder 121H. A vane pump (not shown), arranged at the bottom of the driving shaft, circulates the lubricating oil through the compressing unit 120, to lubricate sliding parts thereof and to seal very small gaps compartmentalizing the pressures therein.

An accumulator 250, which is another independent sealed container, is fixed onto a side of the body of the compressor 11 with an accumulator holder 251 and an accumulator band 253. On top of the accumulator 250, a system connecting pipe 255 is provided to connect the accumulator 250 to the refrigerating cycle side. At the bottom of the accumulator 250, the first suction pipe 31 is provided, having one end thereof extending inside of the accumulator 250 to an upper space thereof, and the other end thereof connected to the connecting pipe 103 provided on the body of the compressor 11. In FIG. 1 and the explanation thereof, description of the accumulator 250 is omitted.

It will be now explained how the refrigerant flows in the compressor 11 with reference to FIG. 2. The refrigerant, used for the basic cycle, is overheated in the evaporator (heat absorber) 19, and sent to the first suction pipe 31 via the four-way valve 33, and the accumulator 250. The basic-cycle refrigerant flows through the first suction pipe 31 to enter the lower stage compressing unit 11L. The basic-cycle refrigerant is compressed therein to the intermediate pressure in the lower stage compressing unit 11L, and discharged into the lower stage discharging muffler room 180L.

The injected refrigerant, sucked in from the second suction pipe 23, exchanges heat with the gas discharged from upper stage compressing unit 11H inside the compressor 11, absorbing heat to become drier. The injected refrigerant is then sent to the U-shaped, approximate center of the interconnecting pipe 230, and mixed with the gas (refrigerant) discharged from the lower stage compressing unit 11L.

The refrigerant discharged from the lower stage compressing unit 11L is overheated to some extent. Therefore, the entire mixed refrigerant becomes gasified, but with a lower degree of overheat than the refrigerant that has been just discharged from the lower stage compressing unit 11L. The mixed refrigerant flows through the interconnecting pipe 230, and is sucked into the upper stage compressing unit 11H. After being compressed therein to a high pressure, which is the pressure for the final discharge, the refrigerant is discharged into the internal space of the sealed container 100 via the upper stage discharging muffler room 180H. The gas (refrigerant) discharged into the internal space of sealed container 100 flows through the discharging pipe 101, and discharged out of the sealed container 100. Because the injected refrigerant absorbs heat inside the compressor 11, the injected refrigerant must be less dry, in comparison to a conventional example, before being sucked into the second suction pipe 23.

As described above, in the compressor 11 according to the first embodiment, the gas (refrigerant) discharged from the upper stage compressing unit 11H is cooled by exchanging heat with the injected refrigerant, and discharged out of the sealed container 100. In this manner, the entire sealed container 100 can be cooled down. Therefore, in the air conditioner according to the first embodiment, the limitation in the operating pressure ratio can be further extended, achieving sufficient heater-outlet temperature even in an environment with a low outside temperature. Furthermore, in the air conditioner according to the first embodiment, the limitation in the rotation frequency of the compressor 11 can be better overcome, enabling a higher heater capacity.

The refrigerant sucked into the upper stage compressing unit 11H must be controlled to be overheated slightly. Therefore, it is necessary to assume the condition of the refrigerant to be sucked into the upper stage compressing unit 11H by detecting the temperature of the discharged gas discharged from the upper stage compressing unit 11H. In the compressor 11 according to the first embodiment, the refrigerant immediately right after the discharge from the upper stage compressing unit 11H has a different temperature than that after the discharge from the sealed container 100. Therefore, it is impossible to accurately measure the temperature of the gas discharged from the upper stage compressing unit 11H if a temperature sensor is provided on top of the sealed container 100, or in the discharging pipe 101.

Therefore, in the compressor 11 according to the first embodiment, the gas discharged from the upper stage compressing unit 11H is injected directly into the sealed container 100, and the temperature sensor 220 is provided on the external surface of the sealed container 100 at a position opposite to where the gas is injected. In this manner, the temperature of the gas discharged from the upper stage compressing unit 11H can be measured more accurately, thus facilitating to achieve the advantages of the present invention sufficiently.

To control the overheating of the refrigerant to be sucked into the lower stage compressing unit 11L, the temperature of the refrigerant (sucked refrigerant) should be measured directly at a position between the evaporator (heat absorber) 19 and the first suction pipe 31. Or, alternatively, the temperature of the gas discharged from the lower stage compressing unit 11L should be measured at a position located more upstream to the position where the discharged gas is mixed with the injected gas, and more upstream to the position where the discharged gas exchanges heat inside the compressor 11.

Therefore, in the compressor 11 according to the first embodiment, to measure the temperature of the gas discharged from the lower stage compressing unit 11L, the temperature sensor 220 is provided at a position more upstream to the position where the discharged gas is mixed with the injected gas, and to the position where the discharged gas exchanges heat inside the compressor 11. In a method that directly measures the temperature of the refrigerant sucked into the lower stage compressing unit 11L, the dryness of the sucked refrigerant cannot be detected if the sucked refrigerant becomes damp. Therefore, considering an avoidance mechanism that must be provided when the sucked refrigerator becomes damp temporarily, it is better to measure the temperature of the discharged gas.

Figure 7:
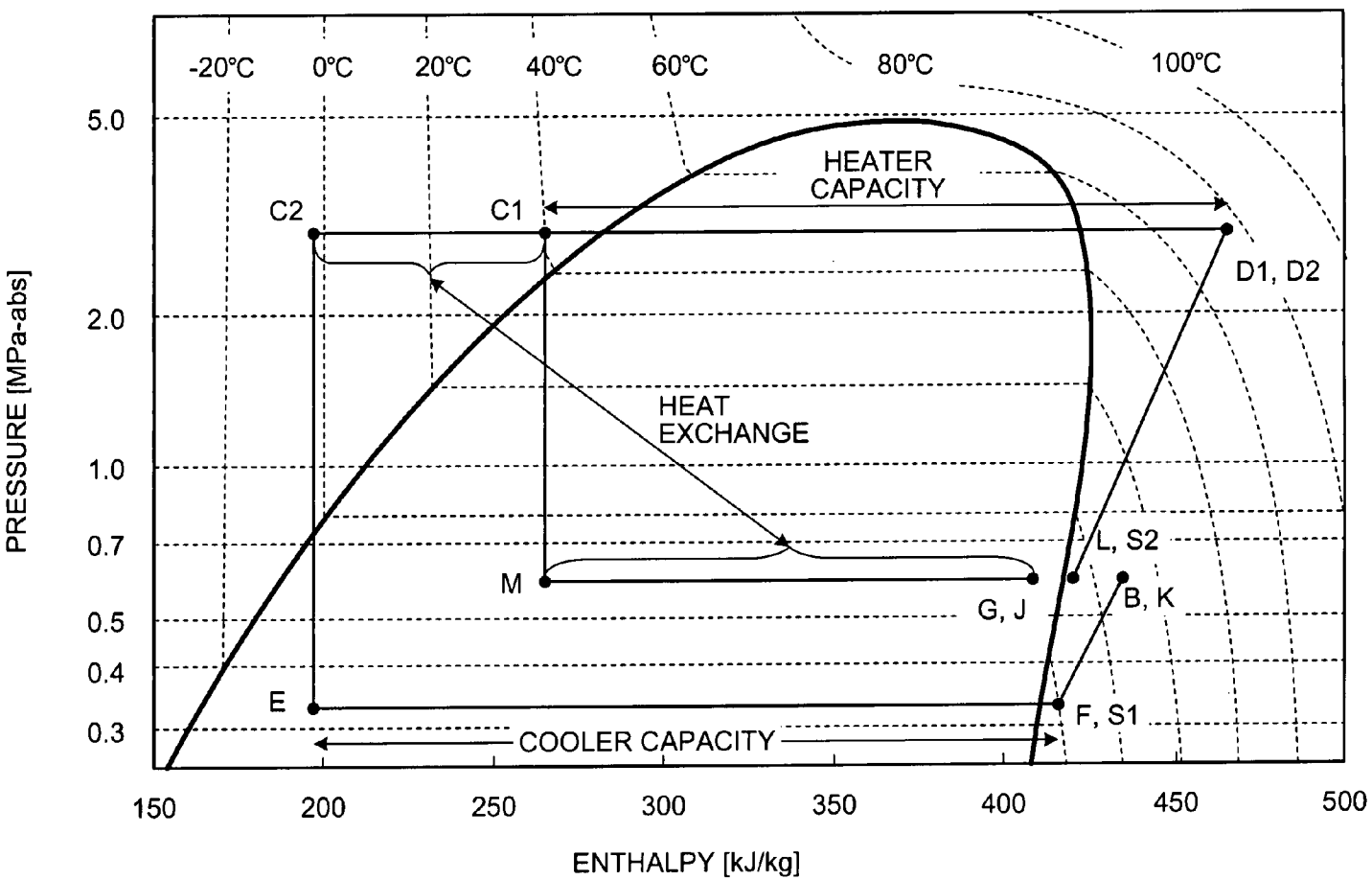
FIG. 7 is a pressure-enthalpy diagram of a conventional internal-heat-exchanging type gas injection cycle.
Figure 8:
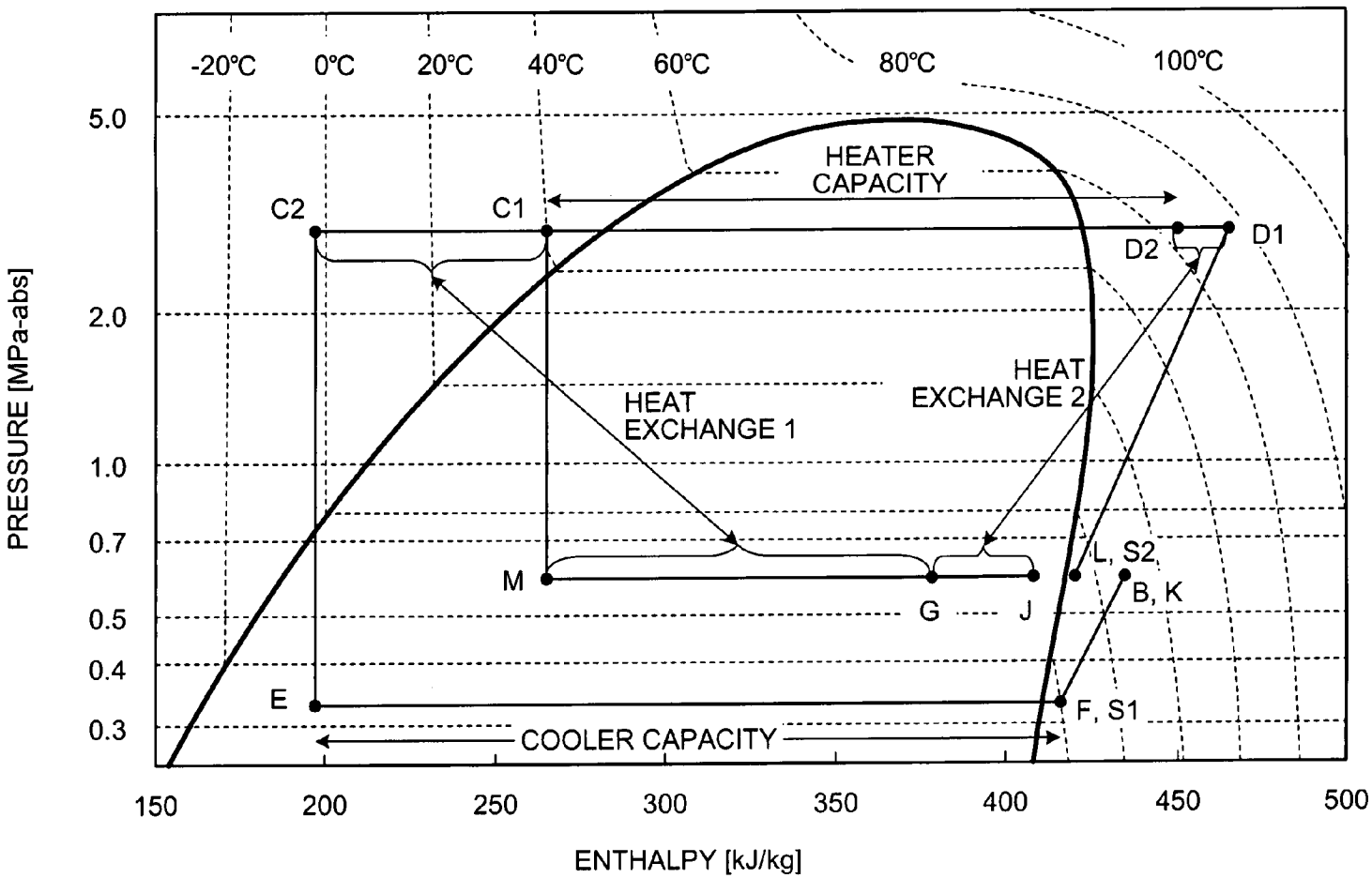
FIG. 8 is a pressure-enthalpy diagram of an internal-heat-exchanging type gas injection cycle in the compressor shown in FIG. 2 in which the compressor is cooled by injected refrigerant.

The advantages of the first embodiment will be now explained using pressure-enthalpy diagrams. FIG. 7 is a pressure-enthalpy diagram for representing a conventional internal-heat-exchanging type gas injection cycle. FIG. 8 is a pressure-enthalpy diagram representing the internal-heat-exchanging type gas injection cycle according to the first embodiment, where the compressor is cooled by the injected refrigerant. In the refrigerating cycle shown in FIGS. 7 and 8, R410A is used for the refrigerant.

The symbols shown in FIGS. 7 and 8 have following meanings:

S1: The refrigerant is being sucked into the lower stage compressing unit 11L;

D1: The refrigerant is being discharged from the upper stage compressing unit;

D2: The refrigerant is being discharged from the sealed container (entering the condenser);

C1: The refrigerant is at the exiting point from the condenser;

E: The refrigerant is at the entering point to the first expanding mechanism unit (entering the evaporator);

F: The refrigerant is at the exiting point from the evaporator;

C2: The basic-cycle refrigerant is at the exiting point from the internal heat exchanger in the gas injection cycle;

M: The injected refrigerant is at the exiting point from the second expanding mechanism unit (the expansion valve for the injection) in the gas injection cycle;

G: The injected refrigerant is at the exiting point from the internal heat exchanger in the gas injection cycle;

J: The injected refrigerant is at a point right before being mixed with the gas discharged from the lower stage compressing unit 11L in the gas injection cycle;

B: The refrigerant is being discharged from the lower stage compressing unit in the gas injection cycle;

K: The gasified refrigerant, discharged from the lower stage compressing unit, is right before being mixed the injected refrigerant in the gas injection cycle;

L: The gasified refrigerant, discharged from the lower stage compressing unit, has just been mixed with the injected refrigerant; and S2: The refrigerant is being sucked into the upper stage compressing unit in the gas injection cycle.

In FIG. 8, which is a representation of the air conditioner according to the first embodiment, heat exchange takes place when the injected refrigerant reaches the exiting point of the internal heat exchanger (G), and when the gasified refrigerant is discharged from the upper stage compressing unit (D1) (heat exchange 2). As the result of the heat exchange 2, the refrigerant moves from the stage (G) to (J), and from (D1) to (D2), respectively. In this manner, the refrigerant discharged from the sealed container 100 in the first embodiment (FIG. 8) becomes lower in temperature than that in a conventional internal-heat-exchanging type gas injection cycle (FIG. 7), which does not perform the heat exchange of the present invention. Therefore, the entire sealed container 100 can be cooled down in the first embodiment.

In FIG. 8, the enthalpy difference of the heater capacities becomes smaller when compared with FIG. 7. However, if Q1=enthalpy difference of the injected refrigerant before (M) and after heat exchange (G)×mass flow rate of the injected refrigerant; and Q2=enthalpy difference of the basic-cycle refrigerant before (C1) and after heat exchange (C2)×mass flow rate of the basic-cycle refrigerant, then, the amount of exchanged heat (1)=Q1=Q2 in a heat exchange 1 that takes place in the internal heat exchanger 29. Because the enthalpy difference of the injected refrigerant before (M) and after heat exchange (G) becomes smaller than that shown in FIG. 7, the mass flow rate of the injected refrigerant can be increased by that amount, resulting in the same heater capacity. In a segment of heat-exchange representing the heater capacity, that is, the enthalpy difference between the stages (D2) and (C1), a ratio of the two-phased state increases. Therefore, the heat exchange efficiency improves, further improving the efficiency of the system.

Alternatively, it is possible to arrange a part of the interconnecting pipe 230 inside the compressor 11, in the same manner as the second suction pipe 23 described above, to allow heat to be exchanged in the compressor 11 between the refrigerant discharged from the lower stage compressing unit 11L through the interconnecting pipe 230, and the gas discharged from the upper stage compressing unit 11H. Furthermore, it is also possible to arrange a part of the interconnecting pipe 230 inside the compressor 11, in the same manner as the second suction pipe 23 described above, to allow heat to be exchanged in the compressor 11 between the refrigerant discharged from the lower stage compressing unit 11L through the interconnecting pipe 230 and mixed with the injected refrigerant with the gas discharged from the upper stage compressing unit 11H.

Figure 9:
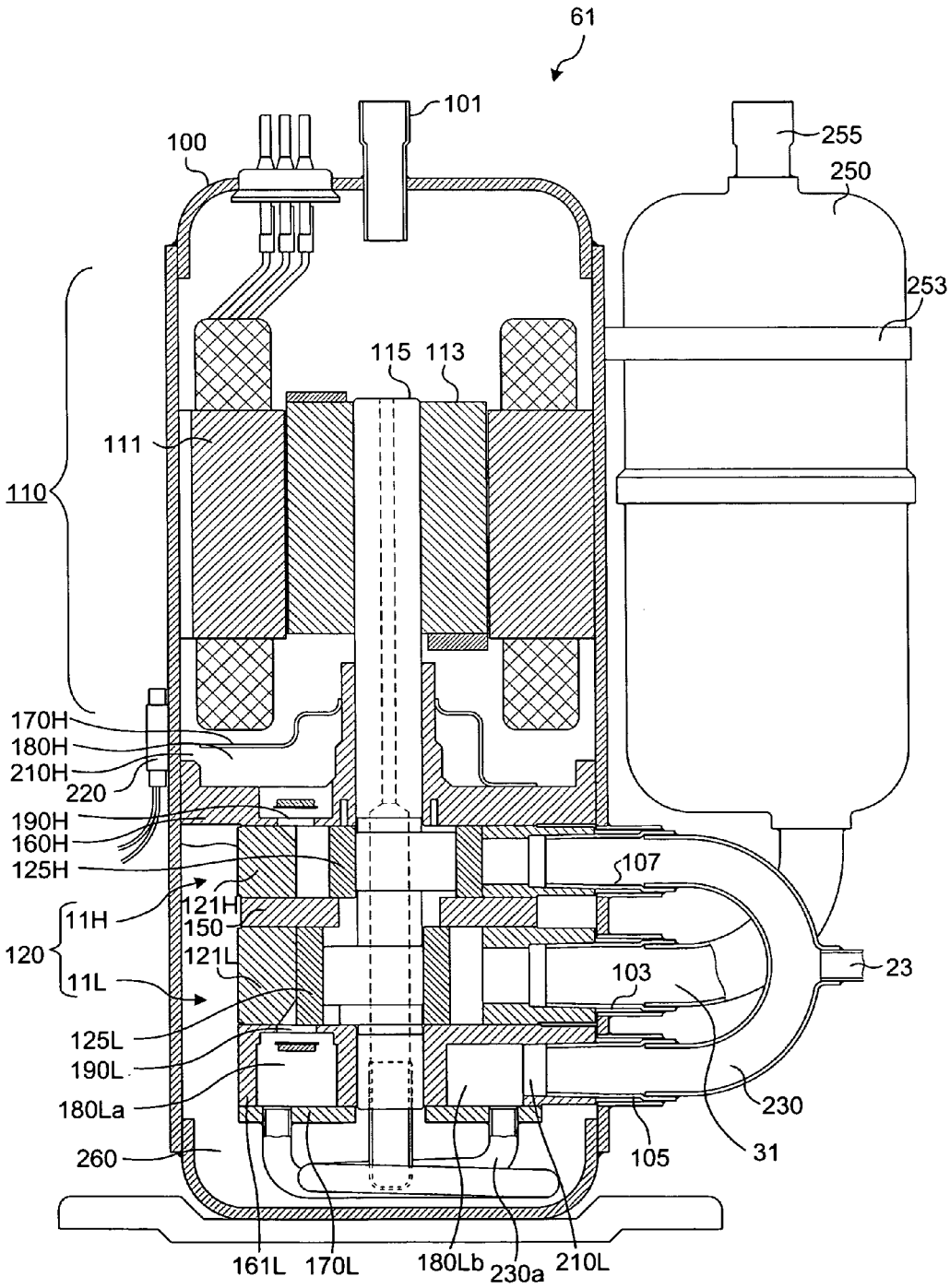
FIG. 9 is a cross-sectional view of a compressor according to a second embodiment of the present invention.
Figure 10:
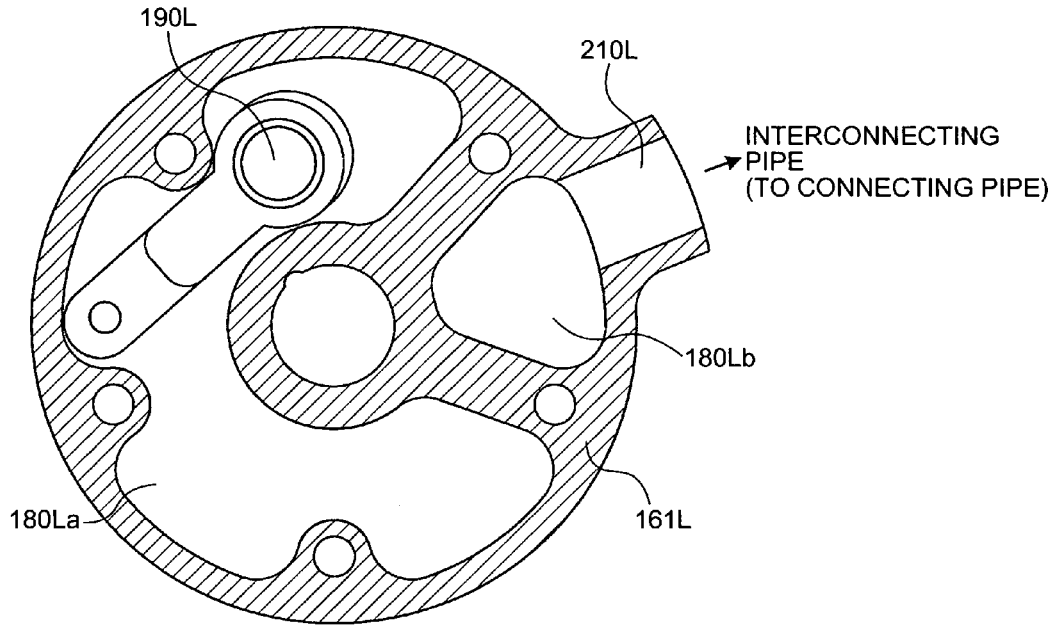
FIG. 10 is a cross-sectional view of a lower stage end plate shown in FIG. 9.

A compressor according to a second embodiment of the present invention will be now explained. FIG. 9 is a cross-sectional view of a compressor 61 according to the second embodiment. The compressor 61 can be provided in the air conditioner according to the first embodiment instead of the compressor 11. FIG. 10 is a schematic for explaining the lower stage end plate 161L in the compressor 61 according to the second embodiment, which is a transverse sectional view thereof.

A refrigerating cycle in the air conditioner according to the second embodiment is the same in the structure as that according to the first embodiment, except for a part of the compressor 61. Therefore, detailed explanations thereof are omitted, by referring to the description in the first embodiment.

In the first embodiment, the second suction pipe 23 is extended into the sealed container 100 between the compressing unit 120 and the motor 110, as shown in FIG. 2. On the contrary, in the second embodiment, a communicating pipe 230*a*, which is a part of the interconnecting pipe connecting the lower stage compressing unit 11L and the upper stage compressing unit 11H, is arranged in the lubricating oil at the bottom of the sealed container 100, as shown in FIG. 9.

In other words, in the first embodiment, the lower stage discharging muffler room 180L includes a space with the right and left sides thereof connected, as shown in FIG. 4. On the contrary, in the second embodiment, the muffler room is separated into the spaces at the right and the left, a lower stage discharging muffler rooms 180La and 180Lb, respectively. These two lower stage discharging muffler rooms 180La and 180Lb are connected by the communicating pipe 230*a*, which is a part of the interconnecting pipe 230. By way of this arrangement, the gas discharged from the lower stage compressing unit 11L is discharged into the lower stage discharging muffler room 180La, flows through the communicating pipe 230*a*, reaches the lower stage discharging muffler room 180Lb, and is sent to the interconnecting pipe 230. According to the second embodiment, the second suction pipe 23 is connected to the approximate U-shaped center of the interconnecting pipe 230, which is the downstream side thereof.

The other elements in the compressor 61 are the same as those according to the first embodiment. Therefore, the same reference numbers as the first embodiment are given in the FIG. 9, and detailed explanations thereof are omitted herein.

With reference to FIG. 9, it will be now explained how the refrigerant flows through the compressor 61. The basic-cycle refrigerant overheated at the evaporator (heat absorber) 19 flows through the four-way valve 33 and the accumulator to reach the first suction pipe 31. Upon entering the lower stage compressing unit 11L through the first suction pipe 31, the basic-cycle refrigerant is compressed to the intermediate pressure in the lower stage compressing unit 11L, and discharged into the lower stage discharging muffler room 180L.

The gas (refrigerant) discharged into the lower stage discharging muffler room 180L flows through the communicating pipe 230*a*, which is a part of the interconnecting pipe 230. While flowing through the communicating pipe 230*a*, the gasified refrigerant exchanges heat with the lubricating oil at the bottom of the sealed container 100, to be discharged to the second suction pipe 23. The basic-cycle refrigerant is mixed with the injected refrigerant sucked through the second suction pipe 23 at the approximate U-shaped center of the interconnecting pipe 230, and sucked into the upper stage compressing unit 11H.

After being compressed therein to a high pressure, which is the pressure for the final discharge, the mixed refrigerant flows through the upper stage discharging muffler room 180H, and discharged into the internal space of the sealed container 100. The gas (refrigerant) discharged into the internal space of the sealed container 100 is further discharged out of the sealed container 100 through the discharging pipe 101. Because the gas discharged from the lower stage compressing unit 11L absorbs heat to become more overheated before being mixed with the injected refrigerant, the refrigerant must be less drier, in comparison with a conventional gas injection cycle, by a degree corresponding to the overheating of the gas discharged from the lower stage compressing unit 11L.

As described above, in the compressor 61 according to the second embodiment, the lubricating oil at the bottom of the sealed container 100 is cooled by exchanging heat with the gas (refrigerant) discharged from the lower stage compressing unit 11L. By way of this cooling, the entire sealed container 100 is also cooled. Moreover, by cooling the lubricating oil, by way of the direct heat exchange with the injected refrigerant, the sliding parts can be prevented more effectively from being seized. Therefore, in the air conditioner according to the second embodiment, the limitation in the operating pressure ratio can be further extended, achieving sufficient heater-outlet temperature even in an environment with a low outside temperature. Furthermore, in the air conditioner according to the second embodiment, the limitation in the rotation frequency of the compressor 61 can be better overcome, enabling a higher heater capacity.

Figure 11:
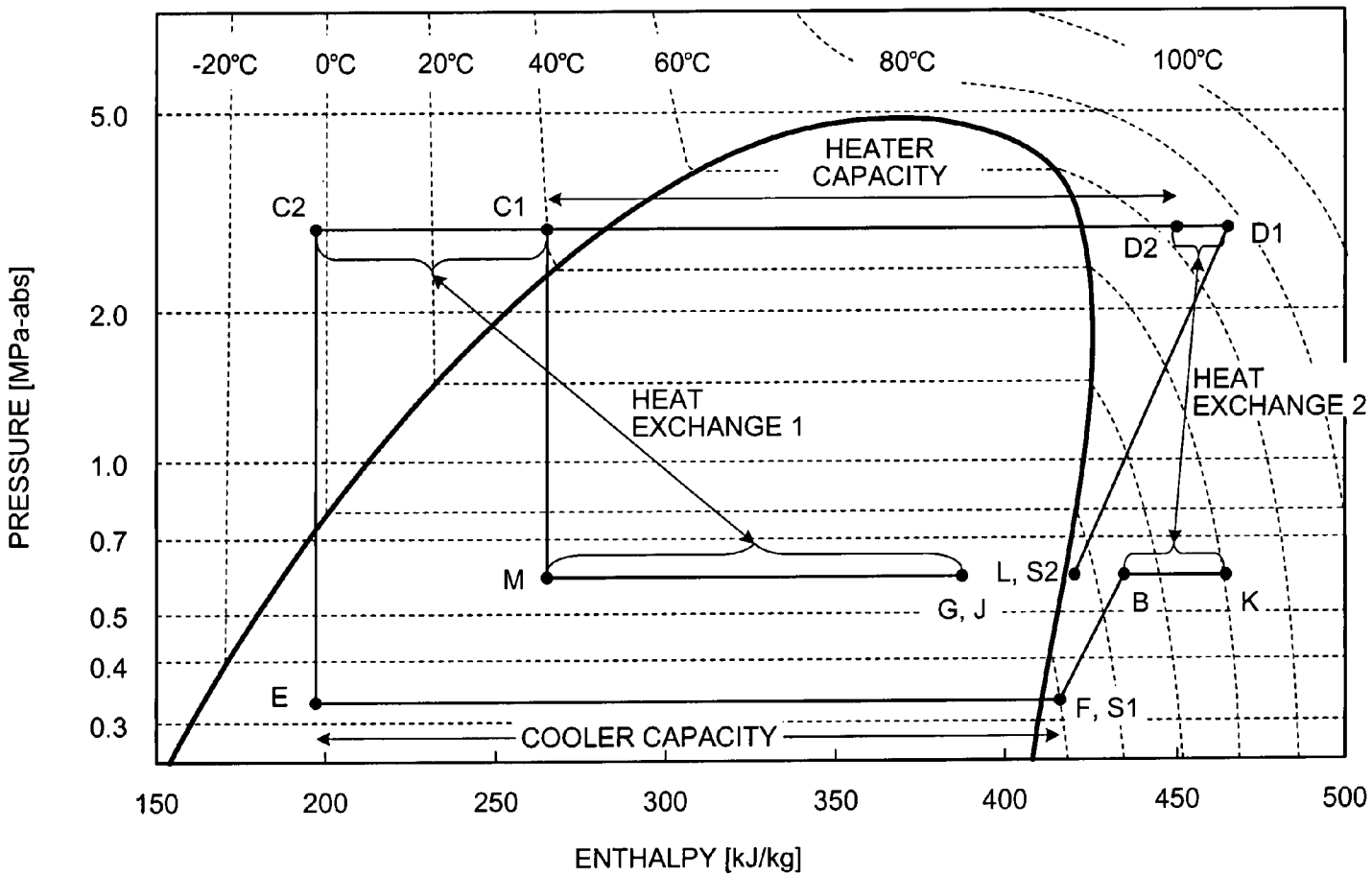
FIG. 11 is a pressure-enthalpy diagram of an internal-heat-exchanging type gas injection cycle in the compressor shown in FIG. 9 in which the compressor is cooled by the gas (refrigerant) discharged from the lower stage compressing unit.

The advantages of the second embodiment will be now explained with reference to pressure-enthalpy diagrams shown in FIG. 7 and FIG. 11. FIG. 11 is a pressure-enthalpy diagram representing the internal-heat-exchanging type gas injection cycle according to the second embodiment, where the compressor is cooled by the gas discharged from the lower stage compressing unit. In the refrigerating cycle shown in FIG. 11, R410A is used for the refrigerant.

In FIG. 11, which is a representation of the second embodiment, heat exchange takes place between the gas discharged from lower stage compressing unit (B), and the gas discharged from the upper stage compressing unit (D1). As a result of the heat exchange, the refrigerant moves from the stage (B) to (K), and from the stage (D1) to (D2), respectively. In this manner, the gas discharged from the sealed container 100 according to the second embodiment (FIG. 11) becomes lower in temperature than that in a conventional internal-heat-exchanging type gas injection cycle (FIG. 7), which does not perform the heat exchange according to the present invention. Therefore, the entire sealed container 100 can be cooled down in the second embodiment. In a segment of heat-exchange representing the heater capacity, which is the enthalpy difference between the stages (D2) and (C1), a ratio of the two-phased state increases. Therefore, the heat exchange efficiency improves, further improving efficiency of the system. Furthermore, when the compressor 61 is started up, the temperature of the gas discharged from the lower stage compressing unit 11L is higher than that of the lubricating oil. Therefore, in the cycle according to the second embodiment, the lubricating oil is heated upon startup of the compressor 61. In this manner, it is possible to reduce the time required to separate the refrigerant, dissolved in the lubricating oil, from the lubricating oil, and to increase the viscosity of the lubricating oil, advantageously improving the reliability of the compressor 61.

Alternatively, a part of the second suction pipe 23 may be arranged in the lubricating oil at the bottom of the sealed container 100 to allow heat exchange between the injected refrigerant and the lubricating oil. Furthermore, it is also possible to arrange a part of the interconnecting pipe 230 in the lubricating oil at the bottom of the sealed container 100, allowing the refrigerant discharged from the lower stage compressing unit 11L to be mixed with the injected refrigerant, and heat to be exchanged between the refrigerant flowing through the interconnecting pipe 230 and the lubricating oil.

Figure 12:
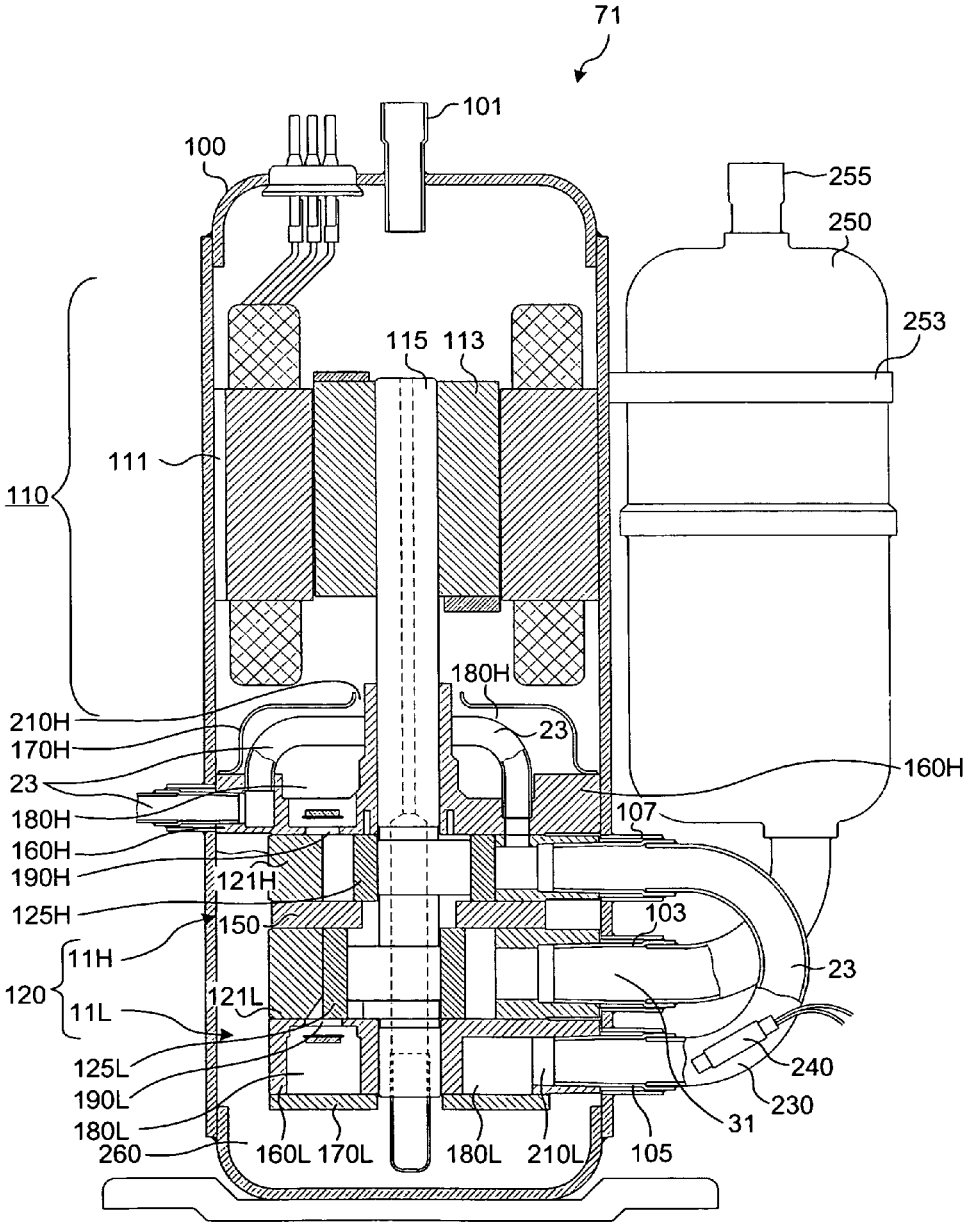
FIG. 12 is a cross-sectional view of a compressor according to a third embodiment of the present invention.

A compressor according to a third embodiment of the present invention will be now explained. FIG. 12 is a cross-sectional view of a compressor 71 according to the third embodiment. The compressor 71 can be provided in the air conditioner according to the first embodiment instead of the compressor 11. A refrigerating cycle in the air conditioner according to the third embodiment is the same in the structure as that according to the first embodiment, except for a part of the compressor 71. Therefore, detailed explanations thereof are omitted, by referring to the description in the first embodiment.

In the compressor 71 according to the third embodiment, to allow the refrigerant in the compressor 71 to exchange heat, the second suction pipe 23 is extended into the upper stage discharging muffler room 180H in the sealed container 100, and connected to the suction side of the upper stage compressing unit 11H.

The other elements in the compressor 71 are the same as those according to the first embodiment. Therefore, the same reference numbers as the first embodiment are given in the FIG. 12, and detailed explanations thereof are omitted herein.

With reference to FIG. 9, it will be now explained how the refrigerant flows through the compressor 71. The basic-cycle refrigerant overheated at the evaporator (heat absorber) 19 flows through the four-way valve 33 and the accumulator 250 to reach the first suction pipe 31. Upon entering the lower stage compressing unit 11L through the first suction pipe 31, the basic-cycle refrigerant is compressed to the intermediate pressure at the lower stage compressing unit 11L, and discharged into the lower stage discharging muffler room 180L.

The injected refrigerant flows through the second suction pipe 23 to reach the upper stage discharging muffler room 180H, and exchanges heat with the gas discharged from the upper stage compressing unit 11H, absorbing heat and becoming further drier. Then, the injected refrigerant is sent to the suction side of the upper stage compressing unit 11H (the suction room 131H), and mixed with the gas (refrigerant) discharged from the lower stage compressing unit 11L. In this manner, the heat of the gas discharged from the upper stage compressing unit 11H can be absorbed reliably.

After being compressed therein to a high pressure, which is the pressure for the final discharge, the mixed refrigerant flows through the upper stage discharging muffler room 180H, and discharged into the internal space of the sealed container 100. The gas (refrigerant) discharged into the internal space of the sealed container 100 is further discharged out of the sealed container 100 through the discharging pipe 101. Because the injected refrigerant absorbs heat inside the compressor 71, the injected refrigerant must be less dry, in comparison with a conventional example, before being sucked into the second suction pipe 23.

As described above, in the compressor 71 according to the third embodiment, the gas (refrigerant) discharged from the upper stage compressing unit 11H is cooled by exchanging heat with the injected refrigerant, and discharged out of the sealed container 100. By way of this cooling, the entire sealed container 100 is cooled down. Therefore, in the air conditioner according to the third embodiment, the limitation in the operating pressure ratio can be further extended, achieving sufficient heater-outlet temperature even in an environment with a low outside temperature. Furthermore, in the air conditioner according to the third embodiment, the limitation in the rotation frequency of the compressor 71 can be better overcome, enabling a higher heater capacity.

Alternatively, a part of the interconnecting pipe 230 may be arranged in the upper stage discharging muffler room 180H, in the same manner described for the second suction pipe 23, to allow heat exchange between the refrigerant discharged from the lower stage compressing unit 11L through the interconnecting pipe 230 and the gas discharged from the upper stage compressing unit 11H in the compressor 71. Furthermore, it is also possible to arrange the part of the interconnecting pipe 230 in the upper stage discharging muffler room 180H, in the same manner described for the second suction pipe 23, allowing heat exchange between the refrigerant flowing through the interconnecting pipe 230, after discharged from the lower stage compressing unit 11L and mixed with the injected refrigerant, and the gas discharged from the upper stage compressing unit 11H in the compressor 71.

Figure 13:
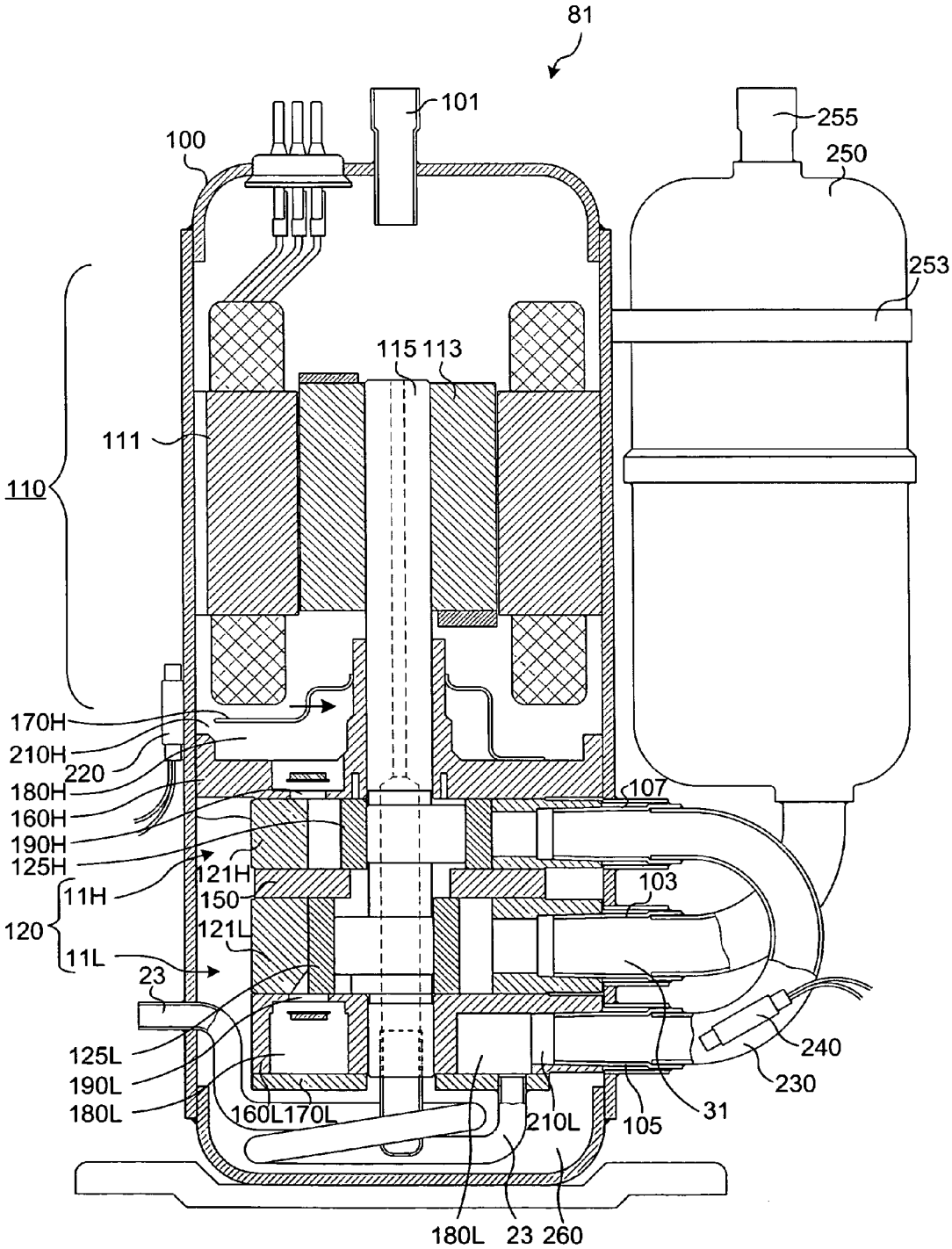
FIG. 13 is a cross-sectional view of a compressor according to a fourth embodiment of the present invention.

A compressor according to a fourth embodiment of the present invention will be now explained. FIG. 13 is a cross-sectional view of a compressor 81 according to the fourth embodiment. The compressor 81 can be provided in the air conditioner according to the first embodiment instead of the compressor 11. A refrigerating cycle in the air conditioner according to the fourth embodiment is the same in the structure as that according to the first embodiment, except for a part of the compressor 81. Therefore, detailed explanations thereof are omitted, by referring to the description in the first embodiment.

In the compressor 81 according to the fourth embodiment, to allow the refrigerant in the compressor 81 to exchange heat, the second suction pipe 23 is extended into a lubricating oil reservoir 260 located at the bottom of the sealed container 100, and connected to the lower stage discharging muffler room 180L.

The other elements in the compressor 81 are the same as those according to the first embodiment. Therefore, the same reference numbers as the first embodiment are given in the FIG. 13, and detailed explanations thereof are omitted herein.

With reference to FIG. 13, it will be now explained how the refrigerant flows through the compressor 81. The basic-cycle refrigerant overheated at the evaporator (heat absorber) 19 flows through the four-way valve 33 and the accumulator 250 to reach the first suction pipe 31. Upon entering the lower stage compressing unit 11L through the first suction pipe 31, the basic-cycle refrigerant is compressed to the intermediate pressure at the lower stage compressing unit 11L, and discharged into the lower stage discharging muffler room 180L.

The injected refrigerant flows through the second suction pipe 23 to reach the pipe arranged in the lubricating oil reservoir 260 located at the bottom of the sealed container 100. While flowing through this pipe, the injected refrigerant exchange heat with the lubricating oil at the bottom of the sealed container 100, absorbing heat and becoming drier, and discharged to the lower stage discharging muffler room 180L. In the lower stage discharging muffler room 180L, the injected refrigerant is mixed with the gas (refrigerant) discharged from the lower stage compressing unit 11L. The mixed gas flows through the interconnecting pipe 230, and is sucked into the upper stage compressing unit 11H.

After being compressed therein to a high pressure, which is the pressure for the final discharge, the mixed refrigerant flows through the upper stage discharging muffler room 180H, and discharged into the internal space of the sealed container 100. The gas (refrigerant) discharged into the internal space of the sealed container 100 is further discharged out of the sealed container 100 through the discharging pipe 101. Because the injected refrigerant absorbs heat inside the compressor 81, the injection heat must less dry, in comparison with a conventional cycle, before being sucked into the second suction pipe 23.

As described above, in the compressor 81 according to the fourth embodiment, the lubricating oil at the bottom of the sealed container 100 is cooled by exchanging heat with the injected refrigerant. By way of this cooling, the entire sealed container 100 is cooled down. Moreover, by reducing the temperature of the lubricating oil, by way of the direct heat exchange with the injected refrigerant, the sliding parts can be prevented more effectively from being seized. Therefore, in the air conditioner according to the fourth embodiment, the limitation in the operating pressure ratio can be further extended, achieving sufficient heater-outlet temperature even in an environment with a low outside temperature. Furthermore, in the air conditioner according to the fourth embodiment, the limitation in the rotation frequency of the compressor 81 can be better overcome, allowing a higher heater capacity.

Figure 14:
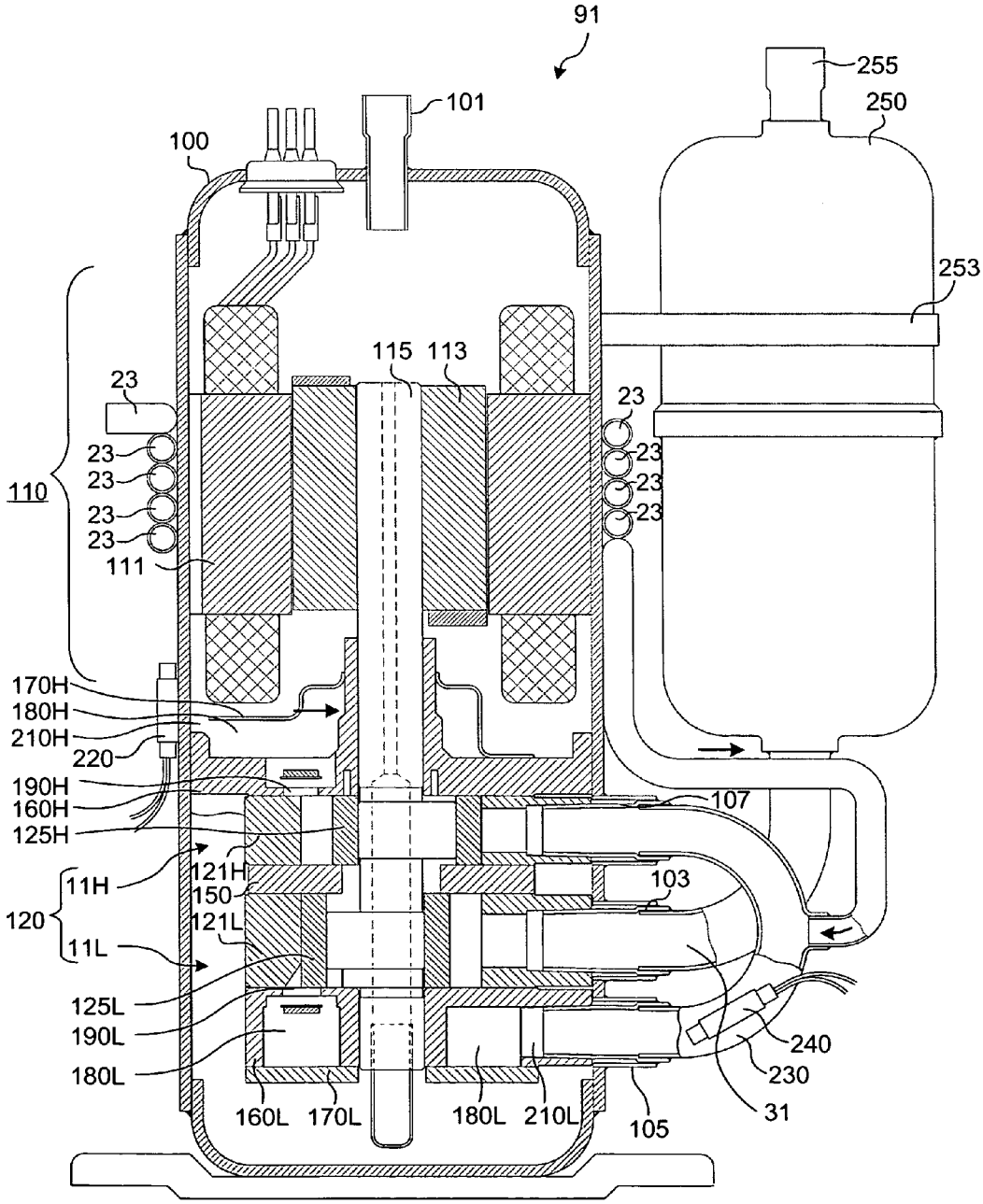
FIG. 14 is a cross-sectional view of a compressor according to a fifth embodiment of the present invention.

A compressor according to a fifth embodiment of the present invention will be now explained. FIG. 14 is a cross-sectional view of a compressor 91 according to the fifth embodiment. The compressor 91 can be provided in the air conditioner according to the first embodiment instead of the compressor 11. A refrigerating cycle in the air conditioner according to the fifth embodiment is the same in the structure as that according to the first embodiment, except for a part of the compressor 91. Therefore, detailed explanations thereof are omitted, by referring to the description in the first embodiment.

In the compressor 91 according to the fifth embodiment, to allow the refrigerant to exchange heat, the second suction pipe 23 is extended in a spiral form, arranged on the external surface of the sealed container 100, and connected to the approximate U-shaped center of the interconnecting pipe 230.

The other elements in the compressor are the same as those according to the first embodiment. Therefore, the same reference numbers as the first embodiment are given in the FIG. 14, and detailed explanations thereof are omitted herein.

With reference to FIG. 14, it will be now explained how the refrigerant flows through the compressor 91. The basic-cycle refrigerant overheated at the evaporator (heat absorber) 19 flows through the four-way valve 33 and the accumulator to reach the first suction pipe 31. Upon entering the lower stage compressing unit 11L through the first suction pipe 31, the basic-cycle refrigerant is compressed to the intermediate pressure at the lower stage compressing unit 11L, and discharged into the lower stage discharging muffler room 180L. Then the basic-cycle refrigerant flows through the interconnecting pipe 230, and is sucked into the upper stage compressing unit 11H.

The injected refrigerant flows through the second suction pipe 23. While flowing through the second suction pipe 23 arranged on the external periphery of the sealed container 100, the injected refrigerant exchanges heat with the gas discharged from the upper stage compressing unit 11H through the wall of the sealed container 100, absorbing heat and becoming further drier. Then, the injected refrigerant is sent to the approximate U-shaped center of the interconnecting pipe 230, and mixed with the gas (refrigerant) discharged from the lower stage compressing unit 11L.

After being compressed to a high pressure, which is the pressure for the final discharge, the mixed refrigerant is discharged into the sealed container 100 via the upper stage discharging muffler room 180H. The gas (refrigerant) discharged into the sealed container 100 is then discharged out of the sealed container 100 through the discharging pipe 101. To allow the injected refrigerant to absorb heat while passing through the second suction pipe 23 arranged on the external periphery of the sealed container 100, the injected refrigerant must be less dry, in comparison to a conventional example, before being sucked into the second suction pipe 23.

As described above, in the compressor 91 according to the fifth embodiment, the gas (refrigerant) discharged from the upper stage compressing unit 11H is cooled by exchanging heat with the injected refrigerant through the wall of the sealed container 100, and discharged out of the sealed container 100. In this manner, the entire sealed container 100 can be cooled down. Therefore, in the air conditioner according to the fifth embodiment, the limitation in the operating pressure ratio can be further extended, achieving sufficient heater-outlet temperature even in an environment with a low outside temperature. Furthermore, in the air conditioner according to the fifth embodiment, the limitation in the rotation frequency of the compressor 91 can be better overcome, allowing a higher heater capacity. Still furthermore, in the compressor 91 according to the fifth embodiment, the internal structure of the compressor 91 can be simplified.

Alternatively, a part of the interconnecting pipe 230 may be arranged on the external surface of the sealed container 100, in the same manner as the second suction pipe 23 described above, allowing heat exchange between the refrigerant flowing through the interconnecting pipe 230, after being discharged from the lower stage compressing unit 11L, and a part of the external surface of the compressor 91. Furthermore, it is also possible to arrange a part of the interconnecting pipe 230, in the same manner as the second suction pipe 23 described above, on the external surface of the sealed container 100, to allow heat exchange between the refrigerant flowing through the interconnecting pipe 230, which is the refrigerant discharged from the lower stage compressing unit 11L and mixed with the injected refrigerant, and a part of the external surface of the compressor 91.

Figure 15:
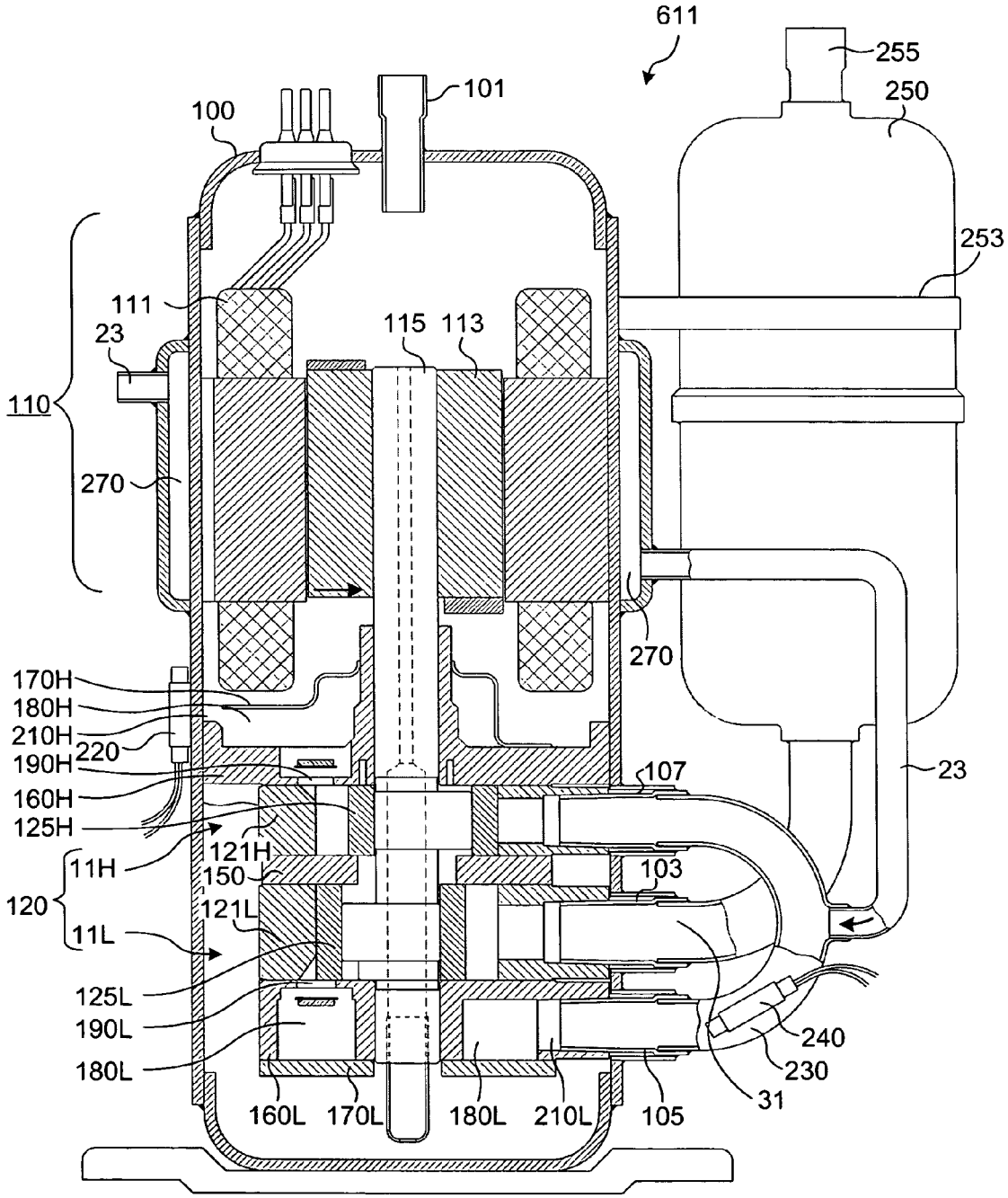
FIG. 15 is a cross-sectional view of a compressor according to a sixth embodiment of the present invention.

A compressor according to a sixth embodiment of the present invention will be now explained. FIG. 15 is a cross-sectional view of a compressor 611 according to the sixth embodiment. The compressor 611 can be provided in the air conditioner according to the first embodiment instead of the compressor 11. A refrigerating cycle in the air conditioner according to the sixth embodiment is the same in the structure as that according to the first embodiment, except for a part of the compressor 611. Therefore, detailed explanations thereof are omitted, by referring to the description in the first embodiment.

The compressor 611 is a variation of the compressor 91 according to the fifth embodiment. In the sixth embodiment, an external heat exchanging room 270 is provided on the external periphery of the sealed container 100, and the second suction pipe 23 is connected thereto. The external heat exchanging room 270 is connected at the U-shaped, approximate center of the interconnecting pipe 230. The external heat exchanging room 270 is formed as a heat transferring surface by covering a part of the external periphery of the sealed container 100 with a metal member, for example.

The other elements in the compressor 611 are the same as those in the compressor 11. Therefore, the same reference numbers as the first embodiment are given in the FIG. 15, and detailed explanations thereof are omitted herein.

With reference to FIG. 15, it will be now explained how the refrigerant flows through the compressor 611. The basic-cycle refrigerant overheated at the evaporator (heat absorber) 19 flows through the four-way valve 33 and the accumulator to reach the first suction pipe 31. Upon entering the lower stage compressing unit 11L through the first suction pipe 31, the basic-cycle refrigerant is compressed to the intermediate pressure in the lower stage compressing unit 11L, and discharged into the lower stage discharging muffler room 180L. Then the basic-cycle refrigerant flows through the interconnecting pipe 230, and is sucked into the upper stage compressing unit 11H.

The injected refrigerant flows through the second suction pipe 23. Upon passing the external heat exchanging room 270 provided on the external periphery of the sealed container 100, the injected refrigerant exchanges heat with the gas discharged into the upper stage compressing unit 11H through the wall of the sealed container 100, absorbing heat and becoming drier, to reach the U-shaped, approximate center of the interconnecting pipe 230. The injected refrigerant is mixed therein with the gas (refrigerant) discharged from the lower stage compressing unit 11L.

After being compressed to a high pressure, which is the pressure for the final discharge, the mixed refrigerant is discharged into the internal space of the sealed container 100 via the upper stage discharging muffler room 180H. The gas (refrigerant) discharged into the internal space of the sealed container 100 is further discharged out of the sealed container 100 through the discharging pipe 101. To allow the injected refrigerant to absorb heat while flowing over the external periphery of the sealed container 100, the injected refrigerant must be less dry, in comparison to a conventional example, before being sucked into the second suction pipe 23.

As described above, in the compressor 611 according to the sixth embodiment, the gas (refrigerant) discharged from the upper stage compressing unit 11H is cooled by exchanging heat with the injected refrigerant through the wall of the sealed container 100, and discharged out of the sealed container 100. In this manner, the entire sealed container 100 can be cooled down. Therefore, in the air conditioner according to the sixth embodiment, the limitation in the operating pressure ratio can be further extended, achieving sufficient heater-outlet temperature even in an environment with a low outside temperature. Furthermore, in the air conditioner according to the sixth embodiment, the limitation in the rotation frequency of the compressor 611 can be better overcome, allowing a higher heater capacity. Still furthermore, in the compressor 611 according to the sixth embodiment, the internal structure of the compressor can be simplified.

Alternatively, a part of the interconnecting pipe 230 may be arranged on the external periphery of the sealed container 100 as the external heat exchanging room 270, allowing heat exchange between the refrigerant flowing through the interconnecting pipe 230, after being discharged from the lower stage compressing unit 11L, and that part of the external surface of the compressor 611. Furthermore, it is also possible to arrange a part of the interconnecting pipe 230 as the external heat exchanging room 270, in the same manner as the second suction pipe 23, arranged on the external periphery of the sealed container 100, allowing heat exchange between the refrigerant flowing through the interconnecting pipe 230, the refrigerant being discharged from the lower stage compressing unit 11L and mixed with the injected refrigerant, and a part of the external surface of the compressor 611.

Figure 16:
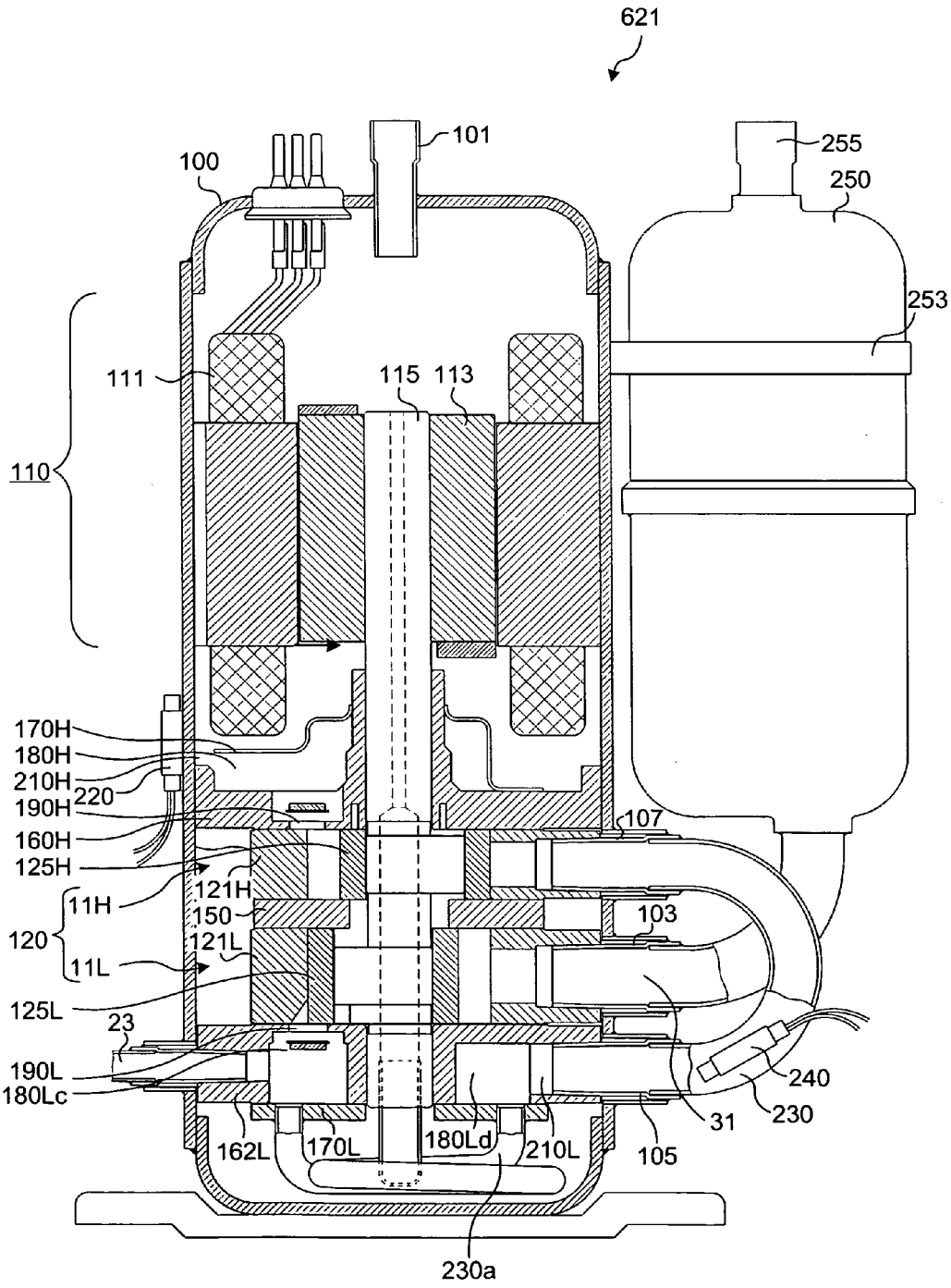
FIG. 16 is a cross-sectional view of a compressor according to a seventh embodiment of the present invention.
Figure 17:
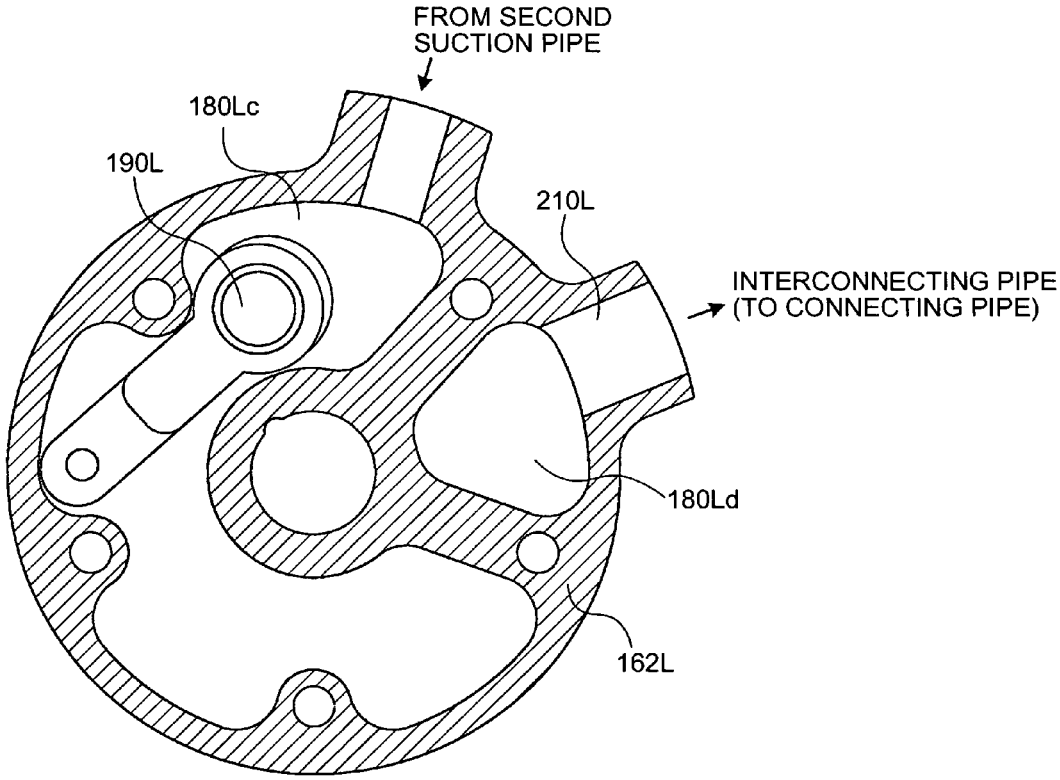
FIG. 17 is a cross-sectional view of a lower stage end plate shown in FIG. 16.

A compressor according to a seventh embodiment of the present invention will be now explained. FIG. 16 is a cross-sectional view of a compressor 621 according to the seventh embodiment. FIG. 17 is cross-sectional view for explaining the lower stage end plate 162L provided in the compressor 621 shown in FIG. 16, which is a transverse sectional view thereof. The compressor 621 can be provided in the air conditioner according to the first embodiment instead of the compressor 11. A refrigerating cycle in the air conditioner according to the seventh embodiment is the same in the structure as that according to the first embodiment, except for a part of the compressor 621. Therefore, detailed explanations thereof are omitted, by referring to the description in the first embodiment.

In the compressor 11 according to the first embodiment, the second suction pipe 23 extends between the compressing unit 120 and the motor 110 into the sealed container 100, as shown in FIG. 2. On the contrary, as shown in FIG. 17, in the compressor 621 according to the seventh embodiment, the second suction pipe 23 is connected to the lower stage discharging muffler room 180L.

Moreover, the lower stage discharging muffler room 180L according to the first embodiment is a single space continuing from the right side to the left side thereof, as shown in FIG. 4. On the contrary, in the seventh embodiment, the lower stage discharging muffler room 180L is separated into two rooms, lower stage discharging muffler rooms 180Lc and 180Ld, located at the right side and the left side thereof, as shown in FIG. 17. These lower stage discharging muffler rooms 180Lc and 180Ld are connected to each other by the communicating pipe 230*a*, which is a part of the interconnecting pipe connecting the lower stage compressing unit 11L and the upper stage compressing unit 11H. The communicating pipe 230*a* is arranged in the lubricating oil at the bottom of the sealed container 100.

The other elements in the compressor 621 are the same as those in the compressor 11 according to the first embodiment. Therefore, the same reference numbers as the first embodiment are given in the FIG. 16, and detailed explanations thereof are omitted herein.

With reference to FIGS. 16 and 17, it will be now explained how the refrigerant flows through the compressor 621. The basic-cycle refrigerant overheated at the evaporator (heat absorber) 19 flows through the four-way valve 33 and the accumulator to reach the first suction pipe 31. Upon entering the lower stage compressing unit 11L through the first suction pipe 31, the basic-cycle refrigerant is compressed to the intermediate pressure at the lower stage compressing unit 11L, and discharged into the lower stage discharging muffler room 180Lc.

The injected refrigerant flows through the second suction pipe 23 to reach the lower stage discharging muffler room 180Lc, and is mixed with the gas (refrigerant) discharged from the lower stage compressing unit 11L. The mixed, gasified refrigerant is sent to the communicating pipe 230*a* located in the lubricating oil at the bottom of the sealed container 100. While passing through the communicating pipe 230*a*, the mixed gas exchanges heat with the lubricating oil at the bottom of the sealed container 100, absorbing heat and becoming drier, and reaches the lower stage discharging muffler room 180Ld. The gas is sucked into the upper stage compressing unit 11H through the interconnecting pipe 230.

As described above, in the compressor 621 according to the seventh embodiment, the injected refrigerant is mixed with the gas discharged from the lower stage compressing unit 11L in the lower stage discharging muffler room 180Lc, and flows into the communicating pipe 230*a* located in the lubricating oil. The mixed gas exchanges heat with the lubricating oil at the bottom of the sealed container 100, flows into the lower stage discharging muffler room 180Ld, and sucked into the upper stage compressing unit 11H through the interconnecting pipe 230.

The lubricating oil, located at the bottom of the sealed container 100, is cooled by way of this heat exchange with the mixed gas, further cooling down the entire sealed container 100. Therefore, in the air conditioner according to the seventh embodiment, the limitation in the operating pressure ratio can be further extended, achieving sufficient heater-outlet temperature even in an environment with a low outside temperature. Furthermore, in the air conditioner according to the seventh embodiment, the limitation in the rotation frequency of the compressor 621 can be better overcome, allowing a higher heater capacity.

Figure 18:
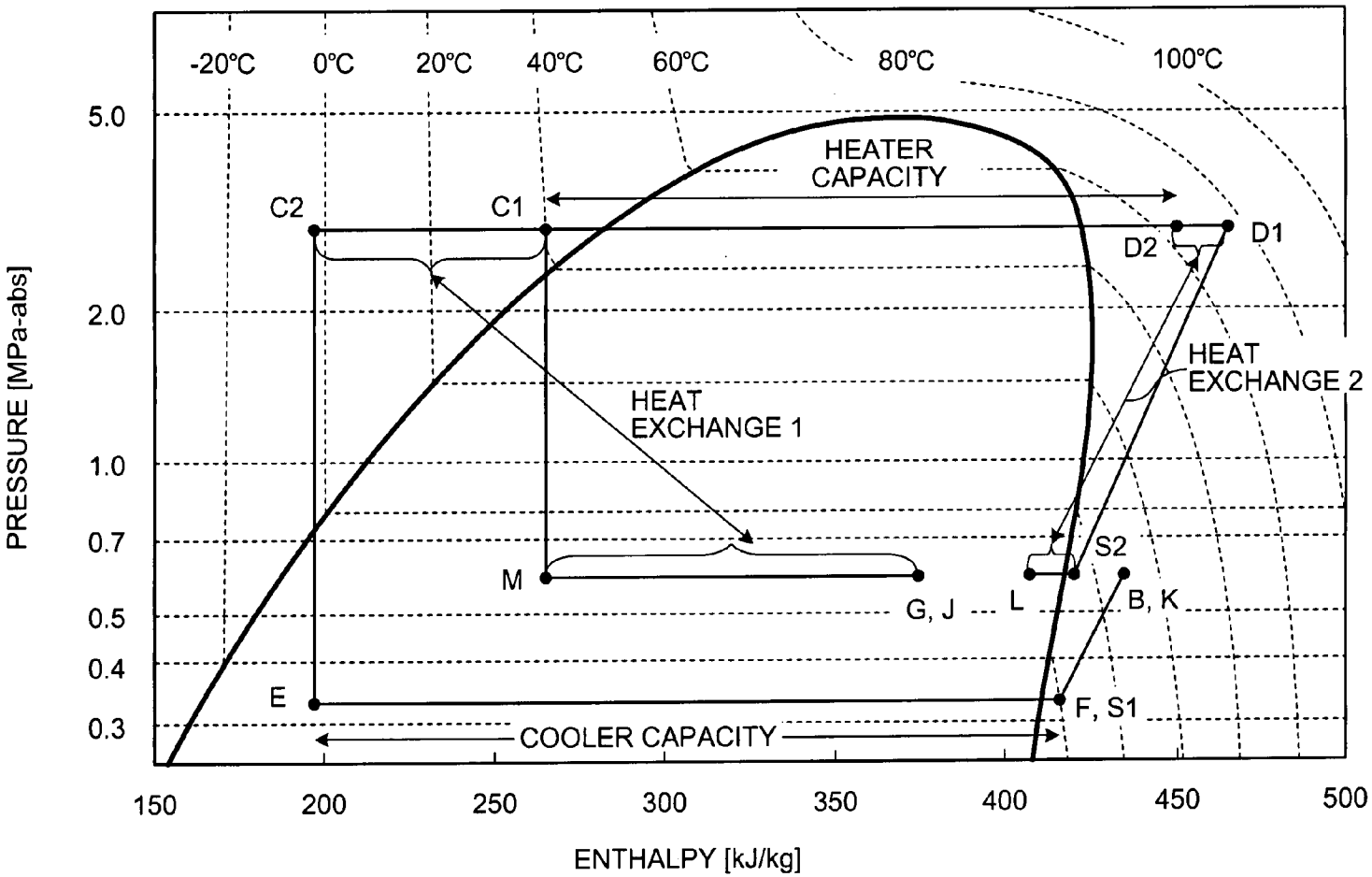
FIG. 18 is a pressure-enthalpy diagram of an internal-heat-exchanging type gas injection cycle in the compressor shown in FIG. 16 in which the compressor is cooled by the gas (refrigerant) discharged from the lower stage compressing unit mixed with the injected refrigerant.

The advantages of the seventh embodiment will be now explained using pressure-enthalpy diagrams shown in FIGS. 7 *and* 18. FIG. 18 is a pressure-enthalpy diagram representing the internal-heat-exchanging type gas injection cycle according to the seventh embodiment, where the compressor is cooled by the injected refrigerant mixed with the gas (refrigerant) discharged from the lower stage compressing unit 11L. In the refrigerating cycle shown in FIG. 18, R410A is used for the refrigerant.

In FIG. 18, which is a representation of the air conditioner according to the seventh embodiment, heat is exchanged between the mixed refrigerant at the stage (L), which is the injected refrigerant of the injection cycle mixed with the gas discharged from the lower stage compressing unit, and the gas at the stage (D1), discharged from the upper stage compressing unit. As a result of the heat exchange, the refrigerant moves from the stage (L) to (S2), and from the stage (D1) to (D2), respectively. In this manner, in the gas injection cycle according to the seventh embodiment (FIG. 18), the temperature of the gas discharged from the sealed container 100 (at the stage D2) can be reduced by a greater degree, in comparison with a conventional internal-heat-exchanging type gas injection cycle which does not perform the heat exchange according to the present invention (FIG. 7). Therefore, the entire sealed container 100 can be cooled down in the seventh embodiment. In a segment of heat-exchange representing the heater capacity, which is the enthalpy difference between the stages (D2) and (C1), a ratio of the two-phased state increases. Therefore, the heat exchange efficiency improves, further improving the system efficiency.

Figure 19:
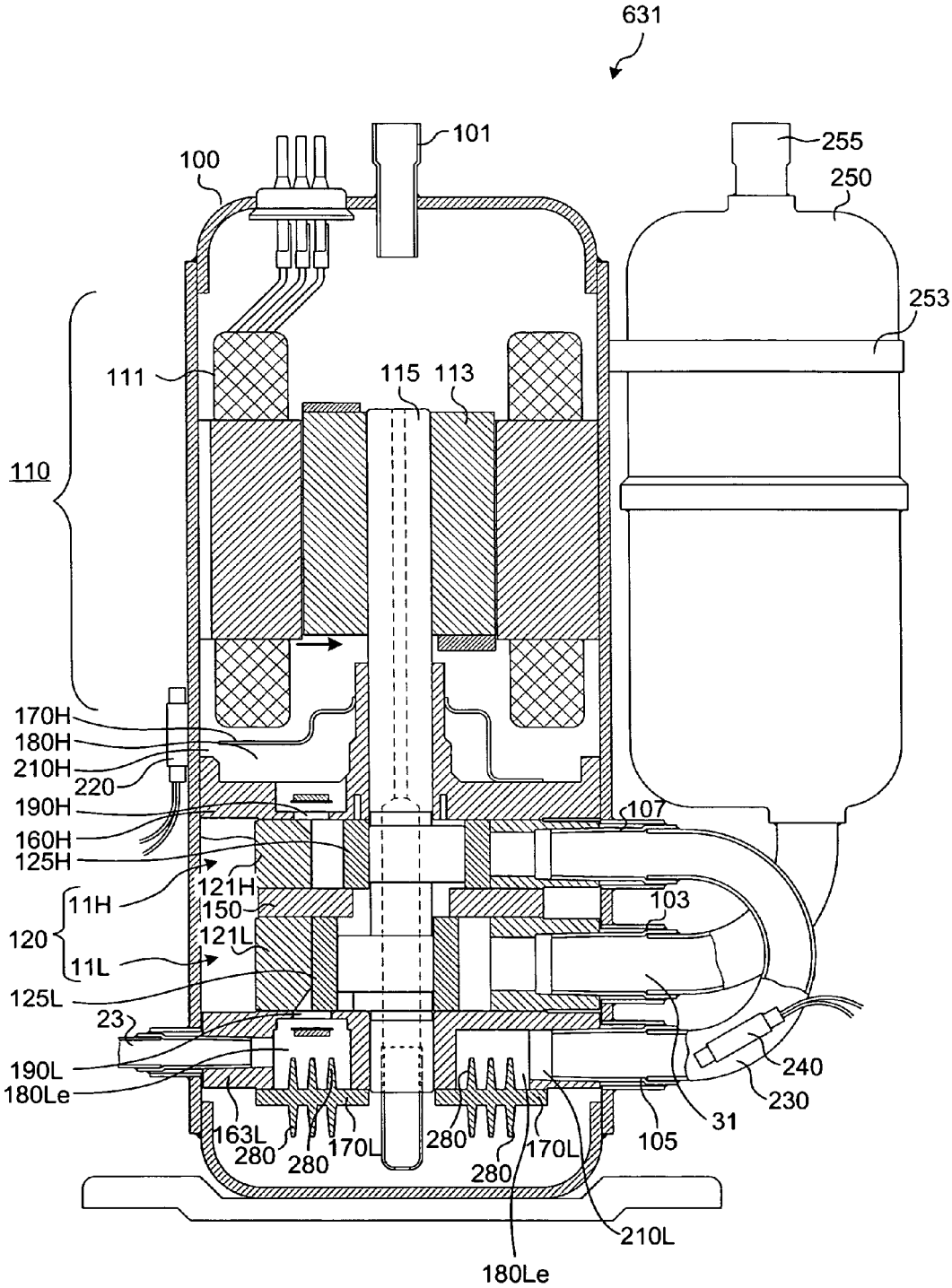
FIG. 19 is a cross-sectional view of a compressor according to an eighth embodiment of the present invention.
Figure 20:
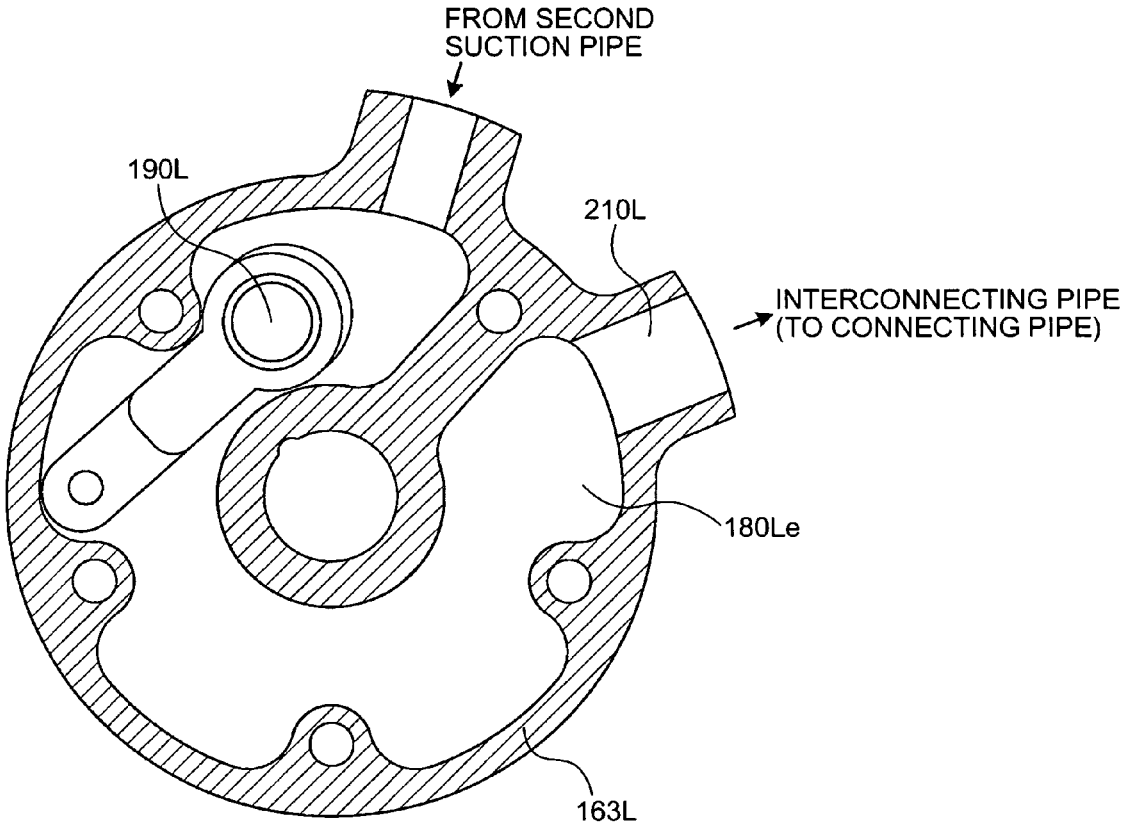
FIG. 20 is a cross-sectional view of a lower stage end plate shown in FIG. 19.

A compressor according to an eighth embodiment of the present invention will be now explained. FIG. 19 is a cross-sectional view of a compressor 631 according to the eighth embodiment. FIG. 20 is cross-sectional view for explaining the lower stage end plate 163L provided in the compressor 631 shown in FIG. 19, which is a transverse sectional view thereof. The compressor 631 can be provided in the air conditioner according to the first embodiment instead of the compressor 11. A refrigerating cycle in the air conditioner according to the eighth embodiment is the same in the structure as that according to the first embodiment, except for a part of the compressor 631. Therefore, detailed explanations thereof are omitted, by referring to the description in the first embodiment.

In the compressor 11 according to the first embodiment, the second suction pipe 23 extends between the compressing unit 120 and the motor 110 into the container 100, as shown in FIG. 2. On the contrary, in the compressor 631 according to the eighth embodiment, the second suction pipe 23 is connected to the lower stage discharging muffler room 180L, as shown in FIG. 20. Moreover, a fin 280 is provided to the lower stage muffler cover 170L in the eighth embodiment.

In addition, the lower stage discharging muffler room 180L according to the first embodiment is a single space continuing from the right side to the left side thereof, as shown in FIG. 4. On the contrary, in the eighth embodiment, a lower stage discharging muffler room 180Le is structured, as shown in FIG. 20, so that the refrigerant almost circles through the lower stage discharging muffler room 180L.

The other elements in the compressor 631 are the same as those in the compressor 11 according to the first embodiment.

Therefore, the same reference numbers as the first embodiment are given in the FIG. 19, and detailed explanations thereof are omitted herein.

With reference to FIGS. 19 and 20, it will be now explained how the refrigerant flows through the compressor 631. The basic-cycle refrigerant overheated at the evaporator (heat absorber) 19 flows through the four-way valve 33 and the accumulator to reach the first suction pipe 31. Upon entering the lower stage compressing unit 11L through the first suction pipe 31, the basic-cycle refrigerant is compressed to the intermediate pressure at the lower stage compressing unit 11L, and discharged into the lower stage discharging muffler room 180Le.

The injected refrigerant flows through the second suction pipe 23 to reach the lower stage discharging muffler room 180Le, and is mixed with the gas (refrigerant) discharged from the lower stage compressing unit 11L. The mixed, gasified refrigerant exchanges heat with the lubricating oil at the bottom of the sealed container 100 in the lower stage discharging muffler room 180Le, absorbing heat and becoming drier, and sucked into the upper stage compressing unit 11H through the interconnecting pipe 230. Because the injected refrigerant is lower in temperature than the gas discharged from the lower stage compressing unit 11L, the lower stage discharging muffler room 180Le can be cooled down just by injecting the injected refrigerant to the lower stage discharging muffler room 180Le, promoting the heat exchange with the lubricating oil. This arrangement is also within the scope of the present invention. However, the heat exchange can be further promoted by providing the fins 280 to the lower stage muffler cover 170L, in the manner disclosed in the eighth embodiment.

As described above, in the compressor 631 according to the eighth embodiment, the lubricating oil at the bottom of the sealed container 100 is cooled by exchanging heat with the mixed gas, which is the gas (refrigerant) discharged from the lower stage compressing unit 11L mixed with the injected refrigerant. By way of this cooling, the entire sealed container 100 is also cooled down. Therefore, in the air conditioner according to the eighth embodiment, the limitation in the operating pressure ratio can be further extended, achieving sufficient heater-outlet temperature even in an environment with a low outside temperature. Furthermore, in the air conditioner according to the eighth embodiment, the limitation in the rotation frequency of the compressor 631 can be better overcome, allowing higher heating capacity.

The lower stage muffler cover 170L is generally made of an iron-based metal. However, the effects of the present invention can be achieved more effectively if a material of higher heat conductivity, such as copper, brass, or aluminum, is used to promote exchange of the heat.

In the basic gas injection cycle, the same effect can be achieved without using the internal heat exchanger. This is achieved by decompressing the refrigerant to the intermediate pressure in an expanding mechanism located downstream to the heat radiator, and by separating the gas from the liquid in a gas-liquid separator, and by injecting the gas and a part of the liquid in an appropriate amount simultaneously.

Moreover, it should be noted that the compressors 11 to 631 are covered with a heat insulator in the actual practice, although the heat insulator is omitted in the drawings for the first to the eighth embodiments According to an aspect of the present invention, the compressor is cooled by the injected refrigerant or the gas discharged from the lower stage compressing unit, which is at a lower temperature than the gas discharged from the upper stage compressing unit, absorbing the heat of the gas discharged from the upper stage compressing unit and the heat generated in the compressor due to sliding or motor loss. Therefore, it is possible to keep the temperature of the entire compressor low. Thus, the limitation in the operation pressure ratio can be further extended, achieving sufficient heater-outlet temperature even in an environment with a low outside temperature. Furthermore, the limitation in the rotation frequency of the compressor can be better overcome, thus enabling a higher heater capacity.

Furthermore, according to another aspect of the present invention, more heat is radiated in the two-phased state in the condenser. Therefore, heat exchange performance of the condenser can be improved, and the system efficiency can be improved for both of the cooler and the heater operation. Still furthermore, the temperature of the gas discharged from the compressor can be kept low. Therefore, the temperature of a pipe connecting the discharging outlet of the compressor and the condenser can be also kept low. Thus, heat radiation from the connecting pipe can be reduced, preventing degradation of the heater capacity at the condenser. Similar effects can be achieved in a system other than an air conditioner, such as a water heater, with water heating capacity corresponding to the heater capacity at the air conditioner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An injectable two-staged rotary compressor for use in a heat pump system that employs an injection refrigerating cycle, the rotary compressor comprising:

a sealed container;

a lower stage compressing unit;

an upper stage compressing unit;

a motor configured to drive the lower stage compressing unit and the upper stage compressing unit;

a first suction pipe that is connected to a suction side of the lower stage compressing unit and configured to lead a low-pressure refrigerant of the injection refrigerating cycle to the lower stage compressing unit;

an interconnecting path that connects a discharging side of the lower stage compressing unit to a suction side of the upper stage compressing unit;

a discharging pipe that is connected to the sealed container, and configured to discharge a high-pressure refrigerant, discharged into the sealed container from the upper stage compressing unit, into the injection refrigerating cycle; and a second suction pipe configured to lead an intermediary-pressure injected refrigerant that is a wet refrigerant from the injection refrigerating cycle to the interconnecting path, wherein the second suction pipe is extended into the sealed container and is provided with a heat-exchange promoting unit configured to promote exchange of heat between the intermediary-pressure injected refrigerant and an internal space of the sealed container in such a manner that the high-pressure refrigerant is cooled by exchanging heat with the intermediary-pressure injected refrigerant, the heat-exchange promoting unit being a part of the second suction pipe arranged in the high-pressure refrigerant discharged from the upper stage compressing unit in the sealed container.

2. The injectable two-staged rotary compressor according to claim 1, further comprising:

an upper stage discharging muffler room, provided at the discharging side of the upper stage compressing unit, into which the high-pressure refrigerant is discharged from the upper stage compressing unit, wherein the heat-exchange promoting unit is a part of the second suction pipe or a part of the interconnecting path arranged in the upper stage discharging muffler room.

3. The injectable two-staged rotary compressor according to claim 1, wherein lubricating oil is sealed in the sealed container, and the heat-exchange promoting unit is a part of the second suction pipe or a part of the interconnecting path arranged in the lubricating oil.

4. The injectable two-staged rotary compressor according to claim 1, wherein the heat-exchange promoting unit is a part of the second suction pipe or a part of the interconnecting path arranged on the external surface of the sealed container.

5. The injectable two-staged rotary compressor according to claim 1, wherein the heat-exchange promoting unit is an external heat exchanging room formed by covering a part of the external surface of the sealed container, the part of the external surface of the sealed container serving as a heat transferring surface.

6. The injectable two-staged rotary compressor according to claim 1, further comprising:

an upper stage discharging muffler room that is arranged at the discharging side of the upper stage compressing unit, and into which the high-pressure refrigerant from the upper stage compressing unit is discharged;

a discharging hole through which the high-pressure refrigerant is discharged from the upper stage discharging muffler room toward an internal surface of the sealed container; and a temperature sensor that is arranged on the external surface of the sealed container, positioned on the side of the muffler room opposite the side of the muffler room in which the discharge hole is located.

7. The injectable two-staged rotary compressor according to claim 1, wherein an interconnecting pipe that is a part of the interconnecting path is arranged outside of the sealed container; and a temperature sensor is provided on an external surface of the interconnecting pipe at a position closer to a position of the lower stage compressing unit than a point where the second suction pipe is connected.

8. A heat pump system comprising:

a compressor according to claim 1;

a heat radiator;

a first expanding unit;

a heat absorber;

a main circulation pipe that connects the compressor, the heat radiator, the first expanding unit, and the heat absorber in sequence to circulate a refrigerant;

a branching pipe that is arranged on the main circulation pipe at a position between the heat radiator and the first expanding unit;

a second expanding unit;

an injection pipe that connects the branching pipe and the compressor with the second expanding unit therebetween to circulate the injected refrigerant; and a heat exchanger that is configured to perform heat between at least a part of a section between the branching pipe and the first expanding unit in the main circulation pipe, and at least a part of a section between the second expanding unit and the compressor the injection pipe.

9. An injectable two-staged rotary compressor for use in a heat pump system that employs an injection refrigerating cycle, the rotary compressor comprising:

a sealed container;

a lower stage compressing unit;

an upper stage compressing unit;

a motor configured to drive the lower stage compressing unit and the upper stage compressing unit;

a first suction pipe that is connected to a suction side of the lower stage compressing unit and configured to lead a low-pressure refrigerant of the injection refrigerating cycle to the lower stage compressing unit;

an interconnecting path that connects a discharging side of the lower stage compressing unit to a suction side of the upper stage compressing unit;

a discharging pipe that is connected to the sealed container, and configured to discharge a high-pressure refrigerant, discharged into the sealed container from the upper stage compressing unit, into the injection refrigerating cycle; and a second suction pipe that is connected to the interconnecting path and that leads an intermediary-pressure injected refrigerant that is a wet refrigerant from the injection refrigerating cycle to the interconnecting path, a connection point of the second suction pipe and the interconnecting path being located between a connection point of the lower stage compressing unit and the interconnecting path and a connection point of the interconnecting path and the upper stage compressing unit, wherein the interconnecting path is provided with a heat-exchange promoting unit that is arranged upstream of the connection point between the interconnecting path and the second suction pipe and that is arranged in lubricating oil at the bottom of the sealed container and configured to promote exchange of heat between a refrigerant discharged from the lower stage compressing unit and an internal space of the sealed container in such a manner that the lubricating oil is cooled by exchanging heat with the refrigerant, or the interconnecting path is connected to an external heat exchanging room formed on the external periphery of the sealed container in which the high pressure refrigerant flows, the external heat exchanging room covering a part of the external periphery of the sealed container with a metal member to transfer heat, and is provided with a heat-exchange promoting unit configured to promote exchange of heat between a refrigerant discharged from the lower stage compressing unit and the external surface of the sealed container in such a manner that the high-pressure refrigerant is cooled by exchanging heat with the refrigerant.

10. The injectable two-staged rotary compressor according to claim 9, wherein the heat-exchange promoting unit is a part of the second suction pipe or a part of the interconnecting path arranged in the high-pressure refrigerant discharged from the upper stage compressing unit in the sealed container.

11. The injectable two-staged rotary compressor according to claim 9, further comprising:

an upper stage discharging muffler room, provided at the discharging side of the upper stage compressing unit, into which the high-pressure refrigerant is discharged from the upper stage compressing unit, wherein the heat-exchange promoting unit is a part of the second suction pipe or a part of the interconnecting path arranged in the upper stage discharging muffler room.

12. The injectable two-staged rotary compressor according to claim 9, wherein the heat-exchange promoting unit is a part of the second suction pipe or a part of the interconnecting path arranged in the lubricating oil.

13. The injectable two-staged rotary compressor according to claim 9, wherein the heat-exchange promoting unit is a part of the second suction pipe or a part of the interconnecting path arranged on the external surface of the sealed container.

14. The injectable two-staged rotary compressor according to claim 9, wherein the heat-exchange promoting unit is an external heat exchanging room formed by covering a part of the external surface of the sealed container, the part of the external surface of the sealed container configured to serve as a heat transferring surface.

15. The injectable two-staged rotary compressor according to claim 9, further comprising:

an upper stage discharging muffler room that is arranged at the discharging side of the upper stage compressing unit, and into which the high-pressure refrigerant from the upper stage compressing unit is discharged;

a discharging hole through which the high-pressure refrigerant is discharged from the upper stage discharging muffler room toward an internal surface of the sealed container; and a temperature sensor that is arranged on the external surface of the sealed container, positioned on the side of the muffler room opposite the side of the muffler room in which the discharge hole is located.

16. The injectable two-staged rotary compressor according to claim 9, wherein:

an interconnecting pipe that is a part of the interconnecting path is arranged outside of the sealed container; and a temperature sensor is provided on an external surface of the interconnecting pipe at a position closer to a position of the lower stage compressing unit than a point where the second suction pipe is connected.

17. A heat pump system comprising:

a compressor according to claim 9;

a heat radiator;

a first expanding unit;

a heat absorber;

a main circulation pipe is configured to connect the compressor, the heat radiator, the first expanding unit, and the heat absorber in sequence to circulate a refrigerant;

a branching pipe that is arranged on the main circulation pipe at a position between the heat radiator and the first expanding unit;

a second expanding unit;

an injection pipe is configured to connect the branching pipe and the compressor with the second expanding unit therebetween to circulate the injected refrigerant; and a heat exchanger that is operative to perform heat between at least a part of a section between the branching pipe and the first expanding unit in the main circulation pipe, and at least a part of a section between the second expanding unit and the compressor the injection pipe.

18. The injectable two-staged rotary compressor according to claim 13, where in a muffler member forming the lower stage discharging muffler room is provided with the heat-exchange promoting unit configured to promote heat exchange with outside of the lower stage discharging muffler room.

19. The injectable two-staged rotary compressor according to claim 14, wherein the muffler member is made of a material selected from at least one of copper, brass, or aluminum.

* * * * *